US006310011B1

(12) United States Patent
Karn et al.

(10) Patent No.: US 6,310,011 B1
(45) Date of Patent: Oct. 30, 2001

(54) OVERBASED METAL SALTS USEFUL AS ADDITIVES FOR FUELS AND LUBRICANTS

(75) Inventors: Jack L. Karn, Richmond Heights; Jody A. Kocsis, Chagrin Falls; Laurence E. King, Painesville; Paul E. Adams, Willoughby Hills; Vincent A. Notaro, Willoughby, all of OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 08/323,982

(22) Filed: Oct. 17, 1994

(51) Int. Cl.[7] ..... C10M 159/22
(52) U.S. Cl. ..... 508/460
(58) Field of Search ..... 252/39, 41, 33.6, 252/37.7; 508/460

(56) References Cited

U.S. PATENT DOCUMENTS

| | | | |
|---|---|---|---|
| 2,197,832 | 4/1940 | Reiff | 87/9 |
| 2,349,817 | 5/1944 | Farrington et al. | 252/39 |
| 2,776,260 | 1/1957 | Klicker | 252/33.6 |
| 2,933,520 | 4/1960 | Bader | 260/473 |
| 3,038,935 | 6/1962 | Gerber et al. | 260/520 |
| 3,133,944 | 5/1964 | Christensen | 260/434 |
| 3,372,116 | 3/1968 | Meinhardt | 252/36 |
| 3,471,537 | 10/1969 | Berke et al. | 260/429 |
| 3,492,231 | 1/1970 | McMillen | 252/33 |
| 3,493,516 | 2/1970 | Allphin et al. | 252/33.3 |
| 3,595,791 | 7/1971 | Cohen | 252/33.6 |
| 3,761,404 | 9/1973 | Calow et al. | 252/39 |
| 3,793,201 | 2/1974 | Karn | 252/33.4 |
| 4,147,643 | 4/1979 | Pindar et al. | 252/52 |
| 4,627,928 | 12/1986 | Karn | 252/33 |
| 4,828,733 | 5/1989 | Farng et al. | 252/42.7 |
| 4,855,073 | 8/1989 | Murakami et al. | 252/39 |
| 5,281,346 | 1/1994 | Adams et al. | 252/38 |
| 5,338,470 | 8/1994 | Hiebert et al. | 145/22 |
| 5,356,546 * | 10/1994 | Blystone et al. | 252/41 |

FOREIGN PATENT DOCUMENTS 9321143 10/1993 (WO) .

* cited by examiner

*Primary Examiner*—Jerry D. Johnson
(74) *Attorney, Agent, or Firm*—David M. Shold; Michael F. Esposito

(57) ABSTRACT

Lubricants containing metal salts of hydrocarbyl-substituted carboxyalkylene-linked phenols, dihydrocarbyl esters of alkylene dicarboxylic acids, the alkylene group being substituted with a hydroxy group and an additional carboxylic acid group, or alkylene-linked polyaromatic molecules, the aromatic moieties whereof comprise at least one hydrocarbyl-substituted phenol and at least one carboxy phenol, where the hydrocarbyl groups are of sufficient length to provide oil solubility to the salt, exhibit good asphaltene suspension for marine diesel applications. Preferably the salts are overbased.

42 Claims, No Drawings

OVERBASED METAL SALTS USEFUL AS ADDITIVES FOR FUELS AND LUBRICANTS

BACKGROUND OF THE INVENTION

The present invention relates to certain overbased metal salts useful as additives for lubricants based on oils of lubricating viscosity. More particularly, it relates to metal carboxylates of alkylene bis-phenol alkanoic acids and related hydroxy carboxylates. These materials, as well as corresponding neutral salts and certain lactones, are particularly useful as additives for marine diesel lubricants.

The field of lubricant technology is characterized by a never-ending search for improved lubricants and additives. Additives, essential for satisfactory performance of lubricants for all manner of modern engines, serve many roles, including those of providing detergency, antioxidant properties, and suspension of contaminants. The latter function is particularly critical in engines which burn fuel containing asphaltene components, since asphaltenes are often found to contaminate the lubricating oil through blow-by past piston rings. The additives of the present invention, besides their general utility as detergents and antioxidants in many applications such as general diesel applications, are particularly useful in marine diesel engines. Marine diesel engines are typically two- or four-stroke compression ignited engines commonly used in ships for main propulsion or auxiliary power generation applications, or in stationary land-based power generation applications. Marine diesel engines are commonly designed to run on a variety of diesel fuels from good quality light distillate fuel with low sulfur and asphaltene content to poorer quality intermediate or heavy fuels like "Bunker C" or residual fuel oil with generally higher sulfur and asphaltene content. Four stroke engines designs have crankcase oil systems which can become contaminated with diesel fuel either through blow-by or fuel leakage directly into the lubricating oil. Hence the present lubricants are particularly useful in providing asphaltene suspension in lubricants which are employed in the lubrication of such engines.

PCT Publication WO 93/21143, Blystone et al., published Oct. 28, 1993 discloses metal carboxylates of alkylene bis-phenol alkanoic acids useful as additives for fuels and lubricants.

U.S. Pat. No. 5,281,346, Adams et al., Jan. 25, 1994, discloses lubricants for two-cycle engines comprising a major amount of at least one oil of lubricating viscosity and a minor amount of certain compounds of the general formula $A^{Y-}M^{y+}$. A is an anion containing group with a carboxylic aromatic structure.

U.S. Pat. No. 2,933,520 to Bader relates to compounds represented by the formula

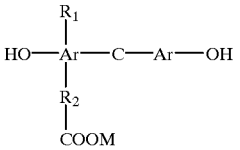

in which $R_1$ may be hydrocarbon, halogen, $R_2$ is hydrocarbon, e.g., alkylene other than methylene and containing at least two carbon atoms and containing up to 10, 12 or even more carbon atoms, Ar groups are aromatic rings, unsubstituted or substituted with alkyl, halogen, nitro, sulfo and others, the nature of each of these groups affecting properties such as boiling point, solubility, toxicity, and bactericidal, fungicidal, insecticidal and like properties.

U.S. Pat. No. 3,038,935 to Gerber et al. teaches the preparation of compounds of the formula

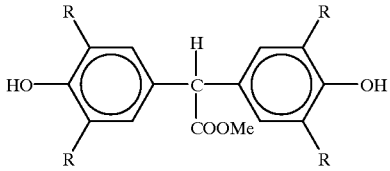

wherein each R is an aliphatic, cycloaliphatic or aromatic radical, Me is Na, K or Li, by reacting alkali metal salts of hindered phenols with dichloroacetic acid. Products are said to be useful for production of rubber auxiliaries, mineral oil additives and stabilizers for plastics.

U.S. Pat. No. 3,133,944 to Christensen teaches heavy metal salts represented by

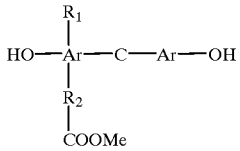

wherein the $R_1$ is alkyl of 1–4 carbons, $R_2$ is alkylene of 2–6 carbons and Ar is an aromatic group which may be substituted with one or more methyl groups and others. The salts are said to be adapted to retard or prevent the growth of biological organisms, particularly molds and mildews.

U.S. Pat. No. 3,471,537 to Berke et al. teaches diphenolic compounds of the formulas

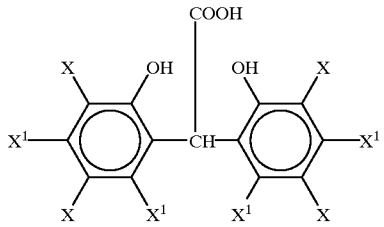

and

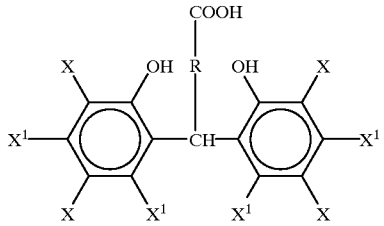

wherein X and $X^1$ are halogen or hydrogen, salts and derivatives as useful for germicides and antiseptics and disinfectants.

U.S. Pat. No. 4,828,733 to Farng et al. relates to copper salts of hindered phenol carboxylic acids.

U.S. Pat. No. 4,627,928, Karn, Dec. 9, 1986, discloses basic magnesium salts of substituted aromatic hydroxy carboxylic acids (e.g. salicylic acids) which can be used in lubricating oils.

A wide variety of metal-containing compounds have been employed, with varying degrees of success as lubricating oil additives. Illustrative are detergents of the ash-containing type. These are well-known in the art and include Newtonian and non-Newtonian neutral and overbased salts of alkali, alkaline earth and transition metals with, for example, sulfonic acids, carboxylic acids, salicylic acids, phosphorus-containing acids, phenols and the like. Among the many publications which disclose overbased metal salts and their method of preparation and use is U.S. Pat. No. 3,429,231, McMillen, Jan. 27, 1970 and U.S. Pat. No. 4,627,928, Karn, Dec. 9, 1986.

SUMMARY OF THE INVENTION

The present invention provides an overbased metal salt of an acidic material selected from the group consisting of (a) hydrocarbyl-substituted carboxyalkylene-linked phenols, (b) dihydrocarbyl esters of alkylene dicarboxylic acids, the alkylene group being substituted with a hydroxy group and an additional carboxylic acid group, and (c) alkylene-linked polyaromatic molecules, the aromatic moieties whereof comprise at least one hydrocarbyl-substituted phenol and at least one carboxy phenol; the hydrocarbyl group or groups of said acidic material being of sufficient length to provide oil solubility to the salt.

The invention further provides lubricants containing the above additives a method for lubricating engines by use of such a lubricant, and, in particular, a method for lubricating an internal combustion engine which burns fuel containing asphaltene components, comprising supplying to the engine a lubricant comprising:

(a) an oil of lubricating viscosity, and (b) a material selected from the group consisting of (i) metal salts of hydrocarbyl-substituted carboxyalkylene-linked phenols, (ii)metal salts of dihydrocarbyl esters of alkylene dicarboxylic acids, the alkylene group being substituted with a hydroxy group and an additional carboxylic acid group, (iii) metal salts of alkylene-linked polyaromatic molecules, the aromatic moieties whereof comprise at least one hydrocarbyl-substituted phenol and at least one carboxy phenol, and (iv) lactones of hydrocarbyl-substituted carboxyalkylene-linked phenols.

The lubrication process is generally made complete by operating the engine.

DETAILED DESCRIPTION OF THE INVENTION

The present invention relates to overbased metal salts of a variety of types, and their use of lubricants. Overbased materials are single phase, homogeneous, generally Newtonian systems characterized by a metal content in excess of that which would be present according to the stoichiometry of the metal and the particular acidic organic compound reacted with the metal.

The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts of the present invention have a metal ratio of at least 1.3, preferably at least 1.5, preferably up to 40, more preferably 20, and even more preferably 10. A preferred metal ratio is 2–6.

The basicity of the overbased materials of the present invention generally is expressed in terms of a total base number. A total base number is the amount of acid (perchloric or hydrochloric) needed to neutralize all of the overbased material's basicity. The amount of acid is expressed as potassium hydroxide equivalents. Total base number is determined by titration of one gram of overbased material with 0.1 Normal hydrochloric acid solution using bromophenol blue as an indicator. The overbased materials of the present invention generally have a total base number of at least 20, preferably 100, more preferably 200. The overbased material generally have a total base number up to 600, preferably 500, more preferably 400. The equivalents of overbased material is determined by the following equation: equivalent weight=(56,100/total base number). For instance, an overbased material with a total base number of 200 has an equivalent weight of 280.5 (eq. wt=56100/200).

The overbased materials (A) are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter.

The acidic organic compounds useful in making overbased compositions in general can include carboxylic acids, sulfonic acids, phosphorus-containing acids, phenols or mixtures of two or more thereof. However, for purposes of the present invention, the overbased materials are based on certain carboxylic acids which contain neighboring hydroxy groups. These materials are described in greater detail below. The acids of this invention are preferably oil-soluble. Usually, in order to provide the desired oil-solubility, the acid will contain at least one hydrocarbyl chain of at least 8 carbon atoms.

The metal compounds useful in making the basic metal salts (A) are generally any Group I or Group II metal compounds (CAS version of the Periodic Table of the Elements). The Group I metals of the metal compound include alkali metals (group IA: sodium, potassium, lithium, etc.) as well as Group IB metals such as copper. The Group I metals are preferably sodium, potassium, lithium and copper, more preferably sodium or potassium, and more preferably sodium. The Group II metals of the metal base include the alkaline earth metals (group 2a: magnesium, calcium, barium, etc.) as well as the Group IIB metals such as zinc or cadmium. Preferably the Group II metals are magnesium, calcium, or zinc, preferably magnesium or calcium, more preferably calcium. Generally the metal compounds are delivered as metal salts. The anionic portion of the salt can be hydroxyl, oxide, carbonate, borate, nitrate, etc.

While overbased metal salts can be prepared by merely combining an appropriate amount of metal base and carboxylic acid substrate, the formation of useful overbased compositions is facilitated by the presence of an additional acidic material. The acidic material can be a liquid such as formic acid, acetic acid, nitric acid, sulfuric acid, etc. Acetic acid is particularly useful. Inorganic acidic materials may also be used such as HCl, $SO_2$, $SO_3$, $CO_2$, $H_2S$, etc., preferably $CO_2$. When $CO_2$ is employed, the product is referred to as a carbonate overbased (or carbonated) material; when $SO_2$, sulfite overbased (or sulfited); when $SO_3$, sulfate overbased (or sulfated). When sulfite overbased materials are further treated with elemental sulfur or an alternative sulfur source, thiosulfate overbased materials can be prepared. When overbased materials are further reacted with a source of boron, such as boric acid or borates, borated overbased materials are prepared. Thus carbonate overbased materials can be reacted with boric acid, with or without evolution of carbon dioxide, to prepare a borated material.

A promoter is a chemical employed to facilitate the incorporation of metal into the basic metal compositions. The promoters are quite diverse and are well known in the art, as evidenced by the cited patents. A particularly comprehensive discussion of suitable promoters is found in U.S. Pat. Nos. 2,777,874, 2,695,910, and 2,616,904. These include the alcoholic and phenolic promoters, which are preferred. The alcoholic promoters include the alkanols of one to about twelve carbon atoms such as methanol, ethanol, amyl alcohol, octanol, isopropanol, and mixtures of these and the like. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, and nonylphenols. Mixtures of various promoters are sometimes used.

Patents specifically describing techniques for making basic salts of the above-described sulfonic acids, carboxylic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Attention is drawn to these patents for their disclosures in this regard as well as for their disclosure of specific suitable basic metal salts.

The first acidic materials which can be employed in preparing the overbased salts of the present invention are hydrocarbyl-substituted carboxyalkylene-linked phenols. These materials, in their simple salt form, (i.e., prior to overbasing) can be represented by the general formula $$A^{Y-}M^{Y+}$$

wherein M represents one or more metal ions, y is the total valence of all M and A represents one or more anion containing groups having a total of about y individual anionic moieties.

These metal salts can be represented by the structure

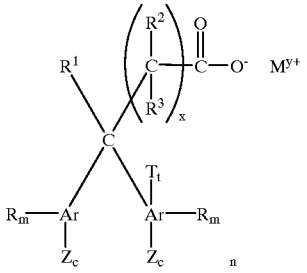

wherein M represents one or more metal ions, y is the total valence of all M, n is a number depending on the value of y, n times the number of anionic moieties in the corresponding parenthetical group is about equal to y, and the remaining elements are as defined hereinabove. Preferably Ar is a benzene nucleus, a bridged benzene nucleus or a naphthalene nucleus.

The Anion-Containing Group A

A represents one or more anion containing groups having a total of about y individual anionic moieties and each anion-containing group is generally a group of the formula (II)

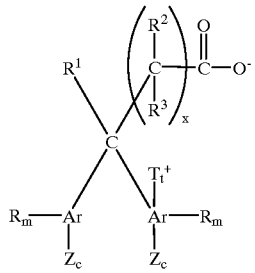

wherein T is selected from the group consisting of (V)

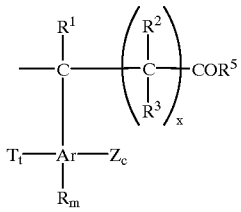

(VI)

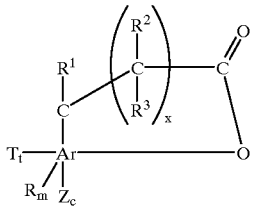

wherein each $R^5$ is independently selected from $O^-$ and $OR^6$ wherein $R^6$ is H or alkyl and each t is independently 0 or 1, wherein T is as hereinbefore defined and wherein each Ar is independently an aromatic group of from 4 to about 30 carbon atoms having from 0 to 3 optional substituents selected from the group consisting of polyalkoxyalkyl, lower alkoxy, nitro, halo or combinations of two or more of said optional substituents, or an analog of such an aromatic nucleus, each R is independently alkyl, alkenyl or aryl containing at least 8 carbon atoms, $R^1$ is H or a hydrocarbyl group, $R^2$ and $R^3$ are each independently H or a hydrocarbyl group, each m is independently an integer ranging from 1 to about 10, x ranges from 0 to about 6, and each Z is independently OH, $(OR^4)_bOH$, or $O^-$wherein each $R^4$ is independently a divalent hydrocarbyl group and b is a number ranging from 1 to about 30 and c ranges from 0 to about 3 with the proviso that when t in Formula (II)=0, or when T is Formula (V), then c is not 0, provided that the sum of m, c and t does not exceed the unsatisfied valences of the corresponding Ar.

The aromatic group Ar of formula (II) can be a single aromatic nucleus such as a benzene nucleus, a pyridine nucleus, a thiophene nucleus, a 1,2,3,4-tetrahydronaphthalene nucleus, etc., or a polynuclear aromatic moiety. Such polynuclear moieties can be of the fused type; that is, wherein pairs of aromatic nuclei making up the Ar group share two points, such as found in naphthalene, anthracene, the azanaphthalenes, etc. Polynuclear aromatic moieties also can be of the linked type wherein at least two nuclei (either mono or polynuclear) are linked through bridging linkages to each other. Such bridging linkages can be chosen from the group consisting of carbon-to-carbon single bonds between aromatic nuclei, ether linkages, keto linkages, sulfide linkages, polysulfide linkages of 2 to 6 sulfur atoms, sulfinyl linkages, sulfonyl linkages, methylene linkages, alkylene linkages, di-(lower alkyl) methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in Ar between aromatic nuclei. For example, a fluorene nucleus has two benzene nuclei linked by both a methylene linkage and a covalent bond. Such a nucleus may be considered to have 3 nuclei but only two of them are aromatic. Normally, Ar will contain only carbon atoms in the aromatic nuclei per se, although other non-aromatic substitution, such as in particular short chain alkyl substitution can also be present. Thus methyl, ethyl, propyl, and t-butyl groups, for instance, can be present on the Ar groups, even though such groups are not explicitly represented in Formula II and in other structures set forth herein.

Likewise, when the term "phenol" is used herein, it is to be understood that this term is not intended to limit the aromatic group of the phenol to benzene. Rather, it is to be understood in its broader sense to include, for example, substituted phenol, hydroxy naphthalenes, and the like. Accordingly, the aromatic group as represented by "Ar", here as well as elsewhere in other formulae in this specification and in the appended claims, can be mononuclear or polynuclear, substituted, and can include other types of aromatic groups as well.

Specific examples of single ring Ar moieties are the following:

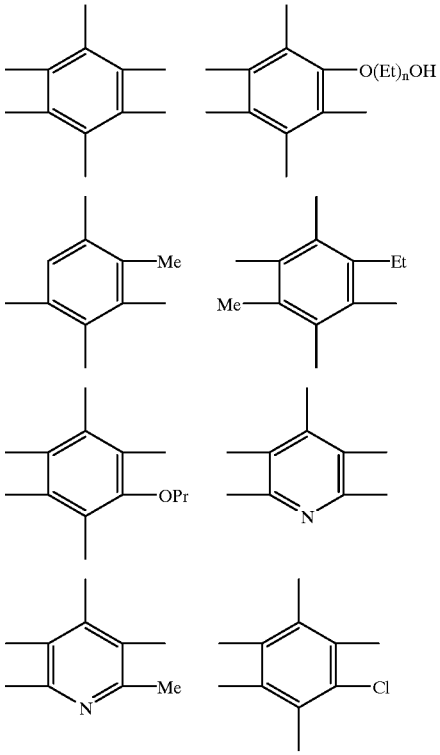

-continued

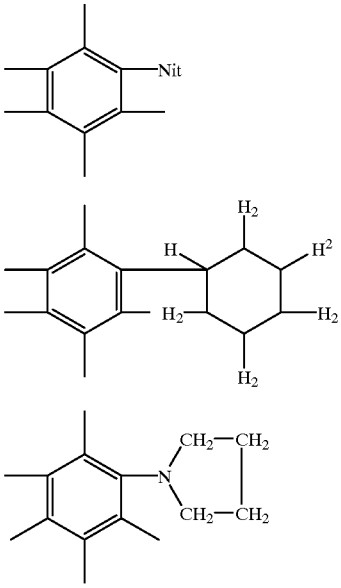

etc., wherein Me is methyl, Et is ethyl or ethylene, as appropriate, Pr is n-propyl, and Nit is nitro.

Specific examples of fused ring aromatic moieties Ar are:

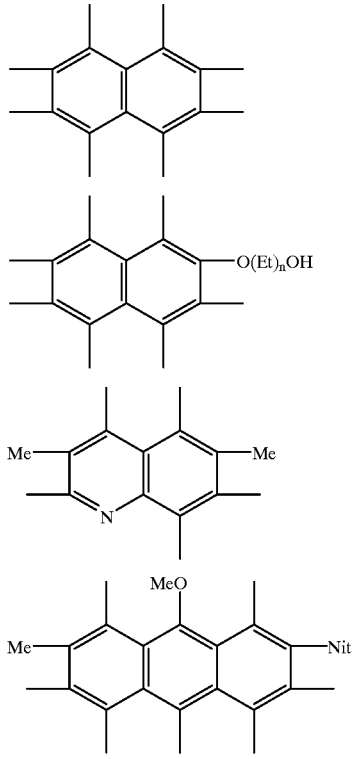

-continued

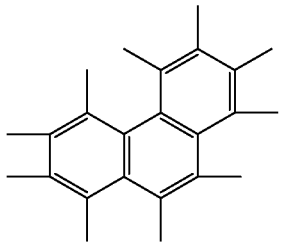

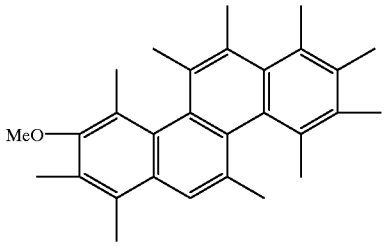

etc.

When the aromatic moiety Ar is a linked polynuclear aromatic moiety, it can be represented by the general formula $$ar(—L—ar—)_w$$

wherein w is an integer of 1 to about 20, each ar is a single ring or a fused ring aromatic nucleus of 4 to about 12 carbon atoms and each L is independently selected from the group consisting of carbon-to-carbon single bonds between ar nuclei, ether linkages (e.g. —O—), keto linkages (e.g.,

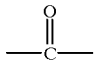

sulfide linkages (e.g., —S—), polysulfide linkages of 2 to 6 sulfur atoms (e.g., $—S—_{2-6}$), sulfinyl linkages (e.g., —S(O)—), sulfonyl linkages (e.g., $—S(O)_2—$), lower alkylene linkages (e.g., $—CH_2—$, $—CH_2—CH_2—$

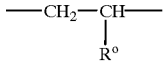

di(lower alkyl)-methylene linkages (e.g.,$—CR°_2—$), lower alkylene ether linkages (e.g., $—CH_2O—$, $—CH_2O—CH_2—$, $—CH_2—CH_2O—$, $—CH_2CH_2OCH_2CH—_2$,

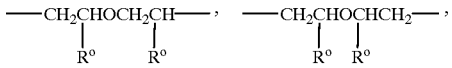

etc.), lower alkylene sulfide linkages (e.g., wherein one or more —O—'s in the lower alkylene ether linkages is replaced with a S atom), lower alkylene polysulfide linkages (e.g., wherein one or more —O— is replaced with a $—S—_{2-6}$ group), amino linkages (e.g.,

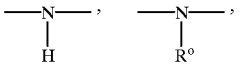

$—CH_2N—$, $—CH_2NCH_2—$, alk—N—, where alk is lower alkylene, etc.), polyamino linkages (e.g., $—N(alkN)_{1-10}$, where the unsatisfied free N valences are taken up with H atoms or R° groups), linkages derived from oxo- or keto-carboxylic acids (e.g.)

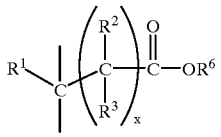

wherein each of $R^1$, $R^2$ and $R^3$ is independently hydrocarbyl, preferably alkyl or alkenyl, most preferably lower alkyl, or H, $R^6$ is H or an alkyl group and x is an integer ranging from 0 to about 8, and mixtures of such bridging linkages (each R° being a lower alkyl group).

Specific examples of linked moieties are:

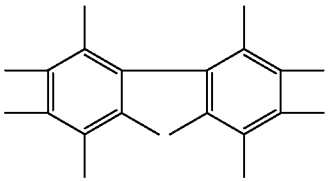

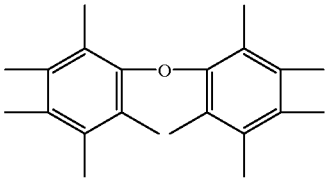

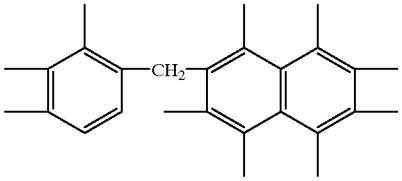

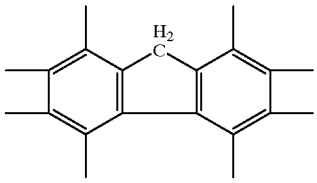

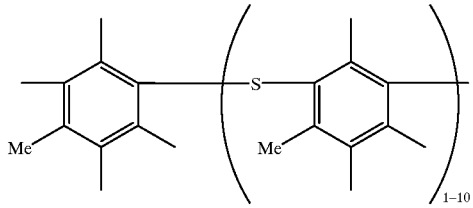

-continued

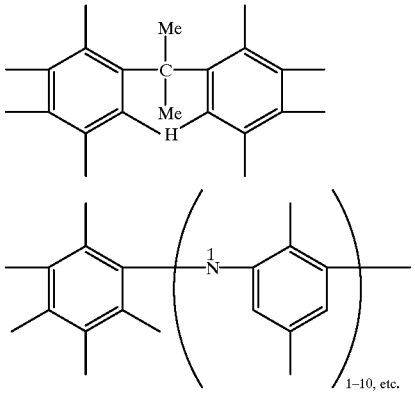

Usually all of these Ar groups have no substituents except for the R and Z groups (and any bridging groups).

For such reasons as cost, availability, performance, etc., Ar is normally a benzene nucleus, a lower alkylene bridged benzene nucleus, or a naphthalene nucleus. Most preferably Ar is a benzene nucleus substituted by an R group in a position para to a Z group.

The Group R

The compounds of formula (I) employed in the compositions of the present invention contain, directly bonded to at least one aromatic group Ar, at least one group R which, independently, is an alkyl, alkenyl or aryl group containing at least 4, and preferably at least 8 carbon atoms, provided that the total number of carbon atoms in all such R groups is at least 12, preferably at least 16 or 24. More than one such group can be present, but usually no more than 2 or 3 are present for each aromatic nucleus in the aromatic group Ar.

The number of R groups on each Ar group is indicated by the subscript m. For the purposes of this invention, each m may be independently an integer ranging from 1 up to about 10 with the proviso that m does not exceed the unsatisfied valences of the corresponding Ar. Frequently, each m is independently an integer ranging from 1 to about 3. In an especially preferred embodiment each m equals 1.

Each R frequently is an aliphatic group containing at least 8 and up to about 750 carbon atoms, frequently from 8 to about 600 carbon atoms, preferably from 8 to about 400 carbon atoms and more preferably from 8 to about 100 carbons. R is preferably alkyl or alkenyl, preferably substantially saturated alkenyl. In one preferred embodiment, R contains at least about 10 carbon atoms, often from 12 to about 100 carbons. In another embodiment, each R contains an average of at least about 30 carbon atoms, often an average of from about 30 to about 100 carbons. In another embodiment, R contains from 12 to about 50 carbon atoms. In a further embodiment, R contains from about 7 or 8 to 30 or 24 carbon atoms, preferably from 12 to about 24 carbon atoms and more preferably from 12 to about 18 carbon atoms. In one embodiment, at least one R is derived from an alkane or alkene having number average molecular weight ranging from about 300 to about 800. In another embodiment, R contains an average of at least about 50 carbon atoms often from about 50 up to about 300, preferably up to about 100 carbon atoms.

When the group R is an alkyl or alkenyl group having from 8 to about 28 carbon atoms, it is typically derived from the corresponding olefin; for example, a dodecyl group is derived from dodecene, an octyl group is derived from octene, etc. When R is a hydrocarbyl group having at least about 30 carbon atoms, it is frequently an aliphatic group made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-mono olefins such as homopolymers of ethylene. These aliphatic hydrocarbyl groups may also be derived from halogenated (e.g., chlorinated or brominated) analogs of such homo- or interpolymers. R groups can, however, be derived from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the R groups may be reduced or eliminated by hydrogenation according to procedures known in the art.

In one preferred embodiment, at least one R is derived from polybutene. In another preferred embodiment, R is derived from polypropylene. In a further preferred embodiment, R is a propylene tetramer.

As used herein, the term "hydrocarbyl group" denotes a group having a carbon atom directly attached to the remainder of the molecule and having predominantly hydrocarbon character within the context of this invention. Thus, the term "hydrocarbyl" includes hydrocarbon, as well as substantially hydrocarbon, groups, Substantially hydrocarbon describes groups, including hydrocarbon based groups, which contain non-hydrocarbon substituents, or non-carbon atoms in a ring or chain, which do not alter the predominantly hydrocarbon nature of the group.

Hydrocarbyl groups can contain up to three, preferably up to two, more preferably up to one, non-hydrocarbon substituent, or non-carbon heteroatom in a ring or chain, for every ten carbon atoms provided this non-hydrocarbon substituent or non-carbon heteroatom does not significantly alter the predominantly hydrocarbon character of the group. Those skilled in the art will be aware of such heteroatoms, such as oxygen, sulfur and nitrogen, or substituents, which include, for example, hydroxyl, halo (especially chloro and fluoro), alkoxyl, alkyl mercapto, alkyl sulfoxy, etc.

Examples of hydrocarbyl groups include, but are not necessarily limited to, the following:

(1) hydrocarbon groups, that is, aliphatic (e.g., alkyl or alkenyl), alicyclic (e.g., cycloalkyl, cycloalkenyl) groups, aromatic groups (e.g., phenyl, naphthyl), aromatic-, aliphatic- and alicyclic- substituted aromatic groups and the like as well as cyclic groups wherein the ring is completed through another portion of the molecule (that is, for example, any two indicated groups may together form an alicyclic radical);

(2) substituted hydrocarbon groups, that is, those groups containing non-hydrocarbon containing substituents which, in the context of this invention, do not significantly alter the predominantly hydrocarbon character; those skilled in the art will be aware of such groups (e.g., halo (especially chloro and fluoro), hydroxy, alkoxy, mercapto, alkylmercapto, nitro, nitroso, sulfoxy, etc.);

(3) hetero groups, that is, groups which will, while having a predominantly hydrocarbon character within the context of this invention, contain atoms other than carbon present in a ring or chain otherwise composed of carbon atoms. Suitable heteroatoms will be apparent to those of ordinary skill in the art and include, for example, sulfur, oxygen, nitrogen. Such groups as, e.g., pyridyl, furyl, thienyl, imidazolyl, etc. are representative of heteroatom containing cyclic groups.

Typically, no more than about 2, preferably no more than one, non-hydrocarbon substituent or non-carbon atom in a chain or ring will be present for every ten carbon atoms in the hydrocarbyl group. Usually, however, the hydrocarbyl groups are purely hydrocarbon and contain substantially no such non-hydrocarbon groups, substituents or heteroatoms.

Preferably, hydrocarbyl groups R are substantially saturated. By substantially saturated it is meant that the group contains no more than one carbon-to-carbon unsaturated bond, olefinic unsaturation, for every ten carbon-to-carbon bonds present. Usually, they contain no more than one carbon-to-carbon non-aromatic unsaturated bond for every 50 carbon-to-carbon bonds present. In an especially preferred embodiment, the hydrocarbyl group R is substantially free of carbon to carbon unsaturation. It is to be understood that, within the content of this invention, aromatic unsaturation is not normally considered to be olefinic unsaturation. That is, aromatic groups are not considered as having carbon-to-carbon unsaturated bonds.

Preferably, hydrocarbyl groups R of the anion containing groups of formula (II) of this invention are substantially aliphatic in nature, that is, they contain no more than one non-aliphatic (cycloalkyl, cycloalkenyl or aromatic) group for every 10 carbon atoms in the R group. Usually, however, the R groups contain no more than one such non-aliphatic group for every 50 carbon atoms, and in many cases, they contain no such non-aliphatic groups; that is, the typical R group is purely aliphatic. Typically, these purely aliphatic R groups are alkyl or alkenyl groups.

Specific non-limiting examples of substantially saturated hydrocarbyl R groups are: methyl, tetra (propylene), nonyl, triisobutyl, oleyl, tetracontanyl, henpentacontanyl, a mixture of poly(ethylene/propylene) groups of about 35 to about 70 carbon atoms, a mixture of the oxidatively or mechanically degraded poly(ethylene/propylene) groups of about 35 to about 70 carbon atoms, a mixture of poly (propylene/1-hexene) groups of about 80 to about 150 carbon atoms, a mixture of poly(isobutene) groups having between 20 and 32 carbon atoms, and a mixture of poly(isobutene) groups having an average of 50 to 75 carbon atoms. A preferred source of hydrocarbyl groups R are polybutenes obtained by polymerization of a $C_4$ refinery stream having a butene content of 35 to 75 weight percent and isobutene content of 15 to 60 weight percent in the presence of a Lewis acid catalyst such as aluminum trichloride or boron trifluoride. These polybutenes contain predominantly (greater than 80% of total repeating units) isobutene repeating units of the configuration

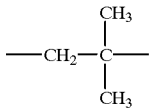

The attachment of a hydrocarbyl group R to the aromatic moiety Ar of the compounds of formula (I) of this invention can be accomplished by a number of techniques well known to those skilled in the art. One particularly suitable technique is the Friedel-Crafts reaction, wherein an olefin (e.g., a polymer containing an olefinic bond), or halogenated or hydrohalogenated analog thereof, is reacted with a phenol in the presence of a Lewis acid catalyst. Methods and conditions for carrying out such reactions are well known to those skilled in the art. See, for example, the discussion in the article entitled, "Alkylation of Phenols" in "Kirk-Othmer Encyclopedia of Chemical Technology", Third Edition, Vol. 2, pages 65–66, Interscience Publishers, a division of John Wiley and Company, N.Y., and U.S. Pat. Nos. 4,379,065; 4,663,063; and 4,708,809, all of which are expressly incorporated herein by reference for relevant disclosures regarding alkylation of aromatic compounds. Other equally appropriate and convenient techniques for attaching the hydrocarbon-based group R to the aromatic moiety Ar will occur readily to those skilled in the art.

The Groups Z

Each Z is independently OH, $(OR^4)_bOH$ or $O^-$wherein each $R^4$ is independently a divalent hydrocarbyl group and b is a number ranging from 1 to about 30.

The subscript c indicates the number of Z groups that may be present as substituents on each Ar group. There will be at least one Z group substituent, and there may be more, depending on the value of the subscript m. For the purposes of this invention, c is a number ranging from 1 to about 3. In a preferred embodiment, c is 1.

As will be appreciated from the foregoing, the compounds of Formula I employed in this invention contain at least two Z groups and may contain one or more R groups as defined hereinabove. Each of the foregoing groups must be attached to a carbon atom which is a part of an aromatic nucleus in the Ar group. They need not, however, each be attached to the same aromatic nucleus if more than one aromatic nucleus is present in the Ar group.

As mentioned hereinabove, each Z group may be, independently, OH, $O^{31}$ , or $(OR^4)_bOH$ as defined hereinabove. In a preferred embodiment, each Z is OH. In another embodiment, each Z may be $O^-$. In another preferred embodiment, at least one Z is OH and at least one Z is $O^-$. Alternatively, at least one Z may be a group of the Formula $(OR\ 4)_bOH$. As mentioned hereinabove, each $R^4$ is independently a divalent hydrocarbyl group. Preferably, $R^4$ is an aromatic or an aliphatic divalent hydrocarbyl group. Most preferably, $R^4$ is an alkylene group containing from 2 to about 30 carbon atoms, more preferably from 2 to about 8 carbon atoms and most preferably 2 or 3 carbon atoms.

The subscript b typically ranges from 1 to about 30, preferably from 1 to about 10, and most preferably 1 or 2 to about 5.

The Groups $R^1$, $R^2$ and $R^3$

Each of the groups $R^1$, $R^2$ and $R^3$ is independently H or a hydrocarbyl group. In one embodiment, each of $R^1$, $R^2$ and $R^3$ is, independently, H or a hydrocarbyl group having from 1 to about 100 carbon atoms, more often from 1 to about 24 carbon atoms. In a preferred embodiment, each of the aforementioned groups is independently hydrogen or alkyl or an alkenyl group. In one preferred embodiment each of $R^1$, $R^2$ and $R^3$ is, independently, H or lower alkyl. In an especially preferred embodiment, each of the aforementioned groups is H. For the purposes of this invention, the term "lower" when used to describe an alkyl or alkenyl group means from 1 to 7 carbon atoms.

The subscript x denotes the number of

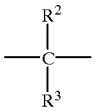

groups present in the anion containing group of Formula II. For the purposes of this invention, x normally ranges from 0 to about 8. In a preferred embodiment, x is 0, 1 or 2. Most preferably x equals 0.

At least one linking group in the molecule will be a carboxyalkylene linking group such as a group derived from glyoxylic acid, represented by $>C(R^1)(CR^2R^3)_xC(O)O^{31}$ in formula (II). However, additional phenol groups can be present, linked, if desired, by other linking groups such as $—CH_2—$ (from, e.g., formaldehyde condensation) or other groups such as those –L– groups described above.

The Group T

It will be apparent that when t=1 in any of Formula II, V or VI, that groups of Formulae V or VI will be present. Termination takes place when t=0. Thus, for example, when t=1 on Formula II, a group of Formula V or VI will be present. It follows then that in order for a group of Formula V or VI to be present in the anion containing group of formula II, t in formula II equals 1.

Likewise, when t=1 in formula II, a group of formula V or VI is present. When t in either formula V or VI equals 0, no further T groups are present. However, when t in formula V or VI equals 1, one or more additional T groups are present, terminating only when finally t=0.

In one preferred embodiment, t in formula II equals zero and no groups of formula V or VI are present. In another preferred embodiment, t in formula II equals 1 and from 1 up to about 3, preferably up to 2 additional groups T of formula V or VI are present.

The Metal Ions M

The symbol M in Formula I represents one or more metal ions. These include alkali metal, alkaline earth metals, zinc, cadmium, lead, cobalt, nickel, iron, manganese, copper and others. Preferred are the alkali and alkaline earth metals, as well as the group 1b and 2b metals (i.e., the columns containing copper and zinc in the CAS version of the periodic table of elements). Especially preferred are sodium, potassium, calcium, magnesium, and lithium. Most preferred are calcium and magnesium, particularly calcium.

The metal ions M may be derived from reactive metals or reactive metal compounds that will react with carboxylic acids or phenols to form carboxylates and phenates. The metal salts may be prepared from reactive metals such as alkali metals, alkaline earth metals, zinc, lead, cobalt, nickel, iron and the like. Examples of reactive metal compounds are sodium oxide, sodium hydroxide, sodium carbonate, sodium methylate, sodium phenoxide, corresponding potassium and lithium compounds, calcium oxide, calcium hydroxide, calcium carbonate, calcium methylate, calcium chloride, calcium phenoxide, and corresponding barium and magnesium compounds, zinc oxide, zinc hydroxide, zinc carbonate, cadmium chloride, lead oxide, lead hydroxide, lead carbonate, nickel oxide, nickel hydroxide, nickel nitrate, cobalt oxide, ferrous carbonate, ferrous oxide, cupric acetate, cupric nitrate, etc.

The above metal compounds are merely illustrative of those useful in this invention and the invention is not to be considered as limited to such. Suitable metals and metal-containing reactants are disclosed in many U.S. Patents including U.S. Pat. Nos. 3,306,908; 3,271,310; and U.S. Pat. No. Reissue 26,433.

The Total Valence y

The skilled worker will appreciate that the compounds of the general formula $$A^{y-}M^{y+} \quad (I)$$

as written, constitute a substantially neutral metal salt, although the salts of the present invention will generally be overbased, as described in detail above. The metal salt is a carboxylate and/or phenate, depending on the nature of A. Depending on the nature of the group Z in Formula (II), A may be a carboxylate, or a carboxylate-phenate, a carboxylate-mixed phenate/phenol, a carboxylate-alkoxylate, a carboxylate-phenate-alkoxylate, a carboxylate-phenate/phenol-alkoxylate, etc. The group A may also represent mixtures of two or more of these. Accordingly, it is apparent that the value of y is dependent upon the number of anion-containing moieties making up A and on the valence of the metal ion M.

The metal salts of Formula (I) may be readily prepared by reacting (a) a reactant of the formula

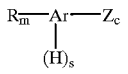

(III)

wherein R is alkyl, alkenyl or aryl containing at least 8 carbon atoms, m ranges from 1 to about 10, Ar is an aromatic group containing from 4 to about 30 carbon atoms having from 0 to 3 optional substituents selected as described hereinabove, or an analog of such an aromatic nucleus, wherein s is an integer of at least 1 and wherein the total of s+m does not exceed the available valences of Ar and Z is selected from the group consisting of OH or $(OR^4)_bOH$ wherein each $R^4$ is independently a divalent hydrocarbyl group and b is a number ranging from 1 to about 30 and c ranges from 1 to about 3, with (b) a carboxylic reactant of the formula $$R^1CO(CR^2R^3)_xCOOR^6 \quad (IV)$$

wherein $R^1$, $R^2$ and $R^3$ are independently H or a hydrocarbyl group, $R^6$ is H or an alkyl group, and x is an integer ranging from 0 to about 8 and then reacting the intermediate so formed with a metal-containing reactant to form a salt.

When $R^1$ is H, the aldehyde moiety of reactant (IV) may be hydrated. For example, glyoxylic acid is readily available commercially as the hydrate having the formula $$(HO)_2CH—COOH.$$

Water of hydration as well as any water generated by the condensation reaction is preferably removed during the course of the reaction.

Ranges of values and descriptions of the groups and subscripts appearing in the above Formulae (III) and (IV) are the same as recited hereinabove for Formulae (I) and (II). When $R^6$ is an alkyl group it is preferably a lower alkyl group, most preferably, ethyl or methyl.

The reaction is normally conducted in the presence of a strong acid catalyst. Particularly useful catalysts are illustrated by methanesulfonic acid and para-toluenesulfonic acid. The reaction is usually conducted with the removal of water.

Reactants (a) and (b) are preferably present in a molar ration of about 2:1; however, useful products may be obtained by employing an excess amount of either reactant. Thus, molar ratios of (a):(b) of 1:1, 2:1, 1:2, 3:1, etc. are contemplated and useful products may be obtained thereby. Illustrative examples of reactants (a) of Formula (III) include hydroxy aromatic compounds such as phenols, both substituted and unsubstituted within the constraints imposed on Ar hereinabove, alkoxylated phenols such as those prepared by reacting a phenolic compound with an epoxide, and a variety of aromatic hydroxy compounds. In all the above cases, the aromatic groups bearing the phenolic —OH or $(OR^4)_bOH$ groups may be single ring, fused ring or linked aromatic groups as described in greater detail hereinabove.

Specific illustrative examples of compound (III) employed in the preparation of compounds of Formula (I) containing the anion containing groups A of Formula (II) include hydrocarbon substituted-phenol, naphthol, 2,2'-dihydroxybiphenyl, 4,4-dihydroxybiphenyl, 3-hydroxyanthracene, 1,2,10-anthracenetriol, resorcinol, 2-t-butyl phenol, 4-t-butyl phenol, 2,6-di-t-butyl phenol, octyl phenol, cresols, propylene tetramer-substituted phenol, propylene oligomer (MW 300–800)-substituted phenol, polybutene ($M_n$ about 1000) substituted phenol substituted naphthols corresponding to the above exemplified phenols, methylene-bis-phenol, bis-(4-hydroxyphenyl)-2,2-propane, and hydrocarbon substituted bis-phenols wherein the hydrocarbon substituents have at least 8 carbon atoms for example, octyl, dodecyl, oleyl, polybutenyl, etc., sulfide-and polysulfide-linked analogues of any of the above, alkoxylated derivatives of any of the above hydroxy aromatic compounds, etc. Preferred compounds of Formula (III) are those that will lead to the compounds of Formula (I) having preferred anion containing groups of Formula (II).

The method of preparation of numerous alkyl phenols is well-known. Illustrative examples of alkyl phenols and related aromatic compounds and methods for preparing same are give in U.S. Pat. No. 4,740,321, to which attention is directed.

Non-limiting examples of the carboxylic reactant (b) of Formula IV include glyoxylic acid and other omega-oxoalkanoic acids, keto alkanoic acids such as pyruvic acid, levulinic acid, ketovaleric acids, ketobutyric acids and numerous others. The skilled worker will readily recognize the appropriate compound of Formula (IV) to employ as a reactant to generate a given anion-containing group A. Preferred compounds of Formula (IV) are those that will lead to compounds of Formula (I) having preferred anion containing groups of Formula (II).

It will be noted that in a preferred embodiment, the anion described in detail above is represented by the structure

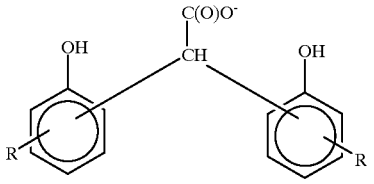

or, even more specifically,

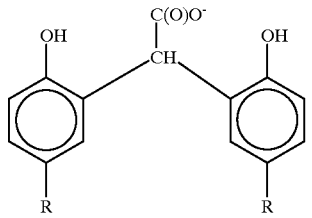

In a preferred embodiment each R is independently an alkyl group containing at least 4, and preferably at least 8 carbon atoms, provided that the total number of carbon atoms in all such R groups is at least 12, preferably at least 16 or 24. Alternatively, each R can be an olefin polymer substituent as described above.

The expressions "represented by the structure" or "represented by," as used in this application, means that the material in question has the chemical structure as indicated or has a related and generally equivalent structure. Thus, for example, an anion "represented by" a structure which shows an ionized carboxylic group and non-ionized phenolic OH groups, as the above, could also, in part or in whole, consist of materials in which one or more of the phenolic OH groups are ionized. Tautomeric structures and positional isomeric structures are also included.

U.S. Pat. No. 2,933,520 (Bader) and U.S. Pat. No. 3,954,808 (Elliott et al) describe procedures for preparing the intermediate via reaction of phenol and acid.

The intermediate product obtained from the reaction of the foregoing hydroxy aromatic compounds and carboxylic acids is then reacted with a metal containing reactant to form a salt. Suitable metal containing reactants have been enumerated hereinabove.

The above examples are intended to be illustrative of suitable reactants and are not intended, and should not be viewed as, an exhaustive listing thereof.

It will be appreciated that the reaction of reactants (a) and (b) will lead to a compound containing a group Z which may be —OH or $(OR^4)_bOH$, as described hereinabove except that when the product is a lactone, Z may be absent. Furthermore, a phenolic group containing product may be reacted with, for example, an epoxide, to generate —$(OR^4)$OH groups, either on the intermediate arising from reaction of (a) and (b) or of a salt thereof.

The intermediate arising from the reaction of (a) and (b) may be a carboxylic acid or a lactone, depending upon the nature of (a). In particular, when (a) is a completely hindered hydroxy aromatic compound, the product from (a) and (b) is a carboxylic acid. When the hydroxy aromatic reactant (a) is less hindered, a lactone is generated.

Often, the intermediate arising from the reaction of (a) and (b) is a mixture comprising both lactone and carboxylic acid.

When the intermediate from (a) and (b) is further reacted with the metal-containing reactant, generally a carboxylic acid salt is formed first. If an excess of metal reactant is used, an amount beyond that needed for formation of a carboxylic acid salt, further reaction takes place at aromatic —OH groups.

From time to time it has been noted that before all lactone is converted to carboxylic acid salt, the beginning of conversion of phenolic —OH groups to O groups, i.e., phenate salts, is observed. This appears to occur most often when the metal reactant is a calcium reactant.

The carboxylate salt forms by reaction of the metal containing reactant with the lactone, opening the lactone ring, forming a carboxylate salt, or from direct reaction with a carboxylic acid group. It is generally preferred to utilize sufficient metal-containing reactant to substantially neutralize all of the carboxylic acid; however, conversion of at least 50%, more preferably 75% of lactone or carboxylic acid to carboxylic acid salt is desirable. Preferably, at least 90%, more preferably 99–100% conversion of lactone or carboxylic acid to carboxylic acid salt is effected.

The overbased salts, the neutral salts, or the corresponding lactones can be used in lubricants, particularly for lubrication of marine diesel engines.

The following specific illustrative Examples describe the preparation of the compounds of Formula (I) useful in the compositions of this invention. In the following examples, as well as in the claims and in the specification of this application, parts are parts by weight, the temperature is degrees Celsius and the pressure is atmospheric, unless otherwise indicated.

As will be readily apparent to those skilled in the art, variations of each of the illustrated reactants and combinations of reactants and conditions may be used.

EXAMPLE 1

A mixture is prepared by combining 3317 parts of a polybutene-substituted phenol prepared by boron trifluoride-phenol catalyzed alkylation of phenol with a polybutene having a number average molecular weight of approximately 1,000 (vapor phase osmometry), 218 parts 50% aqueous glyoxylic acid (Aldrich Chemical) and 1.67 parts 70% aqueous methanesulfonic acid in a reactor equipped with a stirrer, thermo-well, subsurface gas inlet gas inlet and a Dean-Stark trap with condenser for water removal. The mixture is heated under a nitrogen flow to a temperature of 160° C. over one hour. The reaction is held at 160° C. for four hours with removal of water; a total of 146 parts aqueous distillate is collected. Mineral oil diluent, 2284 parts, is added with stirring followed by cooling of the reaction mixture to room temperature. At room temperature, 117.6 parts 50% aqueous sodium hydroxide and 500 parts water are added with stirring followed by exothermic reaction to about 40° C. over 10 minutes. The Dean-Stark trap is removed and the condenser is arranged to allow for reflux. The mixture is heated over one hour to a temperature of 95° C. and is held at this temperature for three hours. The reaction mixture is then cooled to about 60° C. and stripping is started by applying a vacuum to reduce the pressure to about 100 millimeters mercury. The pressure is slowly decreased and the temperature is increased over a period of approximately eight hours until the temperature is 95° C. and the pressure is 20 millimeters mercury. The reaction is then held at this temperature and pressure for three hours to complete stripping. The residue is filtered through a diatomaceous earth filter aid at a temperature of about 95° C. The resulting product, containing approximately 40% mineral oil diluent has a sodium content of 0.58%, ASTM color (D1500) of 7.0 (neat), and a total base number of 13.2. The infra-red spectrum of the product is substantially free of absorption at 1790 $cm^{-1}$ indicating absence of lactone carbonyl.

EXAMPLE 2

A reactor is charged with 3537 parts of a propylene tetramer-substituted phenol prepared by alkylation of phenol with a propylene tetramer in the presence of a sulfonated polystyrene catalyst (marketed as Amberlyst-15 by Rohm & Haas Company), 999 parts of 50% aqueous glyoxylic acid (Hoechst Celanese) and 3.8 parts 70% aqueous methane sulfonic acid. The reaction is heated to 160° C. over three hours under a nitrogen flow. The reaction is held at 160° C. for four hours while collecting 680 parts water in a Dean-Stark trap.

A mineral oil diluent, 2710 parts, is added in one portion with stirring and the reaction is cooled to room temperature. At room temperature, 540 parts 50% aqueous sodium hydroxide and 1089 parts water are added quickly with stirring followed by an exothermic reaction to about 54° C. over ten minutes. The Dean-Stark trap is removed and the condenser is arranged to allow for reflux. The reaction mixture is heated to 95–100° C. and held at this temperature range for three hours. The mixture is then cooled to 60° C. and a vacuum is applied until the pressure reaches 100 millimeters mercury. Vacuum stripping of water is begun while the temperature is slowly increased to 95–100° C. over seven hours while reducing pressure to 20 millimeters mercury. Stripping is continued at 95–100° C. at 20 millimeters mercury pressure for three hours. The residue is filtered through a diatomaceous earth filter aid at 90–100° C. A product containing approximately 40% diluent oil is obtained containing, by analysis, 2.18% sodium and which has an ASTM color (D-1500) of 6.5. The infra-red spectrum shows no significant absorption at 1790 $cm^{-1}$ indicating the product contains no lactone carbonyl.

EXAMPLE 3

A mixture of 681 parts of a polyisobutene substituted phenol-glyoxylic acid reaction product prepared according to the procedure of Example 1, 11 parts calcium hydroxide, 461 parts of mineral oil and 150 parts of water are charged to a reactor and heated under a nitrogen blanket at 100–105° C. for four hours. The reaction mixture is stripped at 115–120° C. at five millimeters mercury pressure over four hours. The residue is filtered at 115–120° C. employing a diatomaceous earth filter aid. The filtered product containing approximately 40% diluent oil contains, by analysis, 0.42% calcium and has a total base number of 15.1. The infra-red spectrum of the product shows a weak absorption at 1778 $cm^{-1}$ indicating a trace of lactone in the product.

EXAMPLE 4

A reactor is charged with 655 parts of a propylene tetramer-substituted phenol prepared according to the procedure given in Example 2, 185 parts 50% aqueous glyoxylic acid (Aldrich) and 0.79 parts 70% aqueous methanesulfonic acid. The flask is equipped with a subsurface nitrogen inlet, a stirrer, thermo-well and Dean-Stark trap for the collection of water. The materials are heated to 120° C. over three hours. 119 parts water is collected (theory=137.5 parts). Mineral oil diluent (490 parts) is added in one increment followed by cooling to 60° C. At 60° C., 52.5 parts lithium hydroxide monohydrate is added. No exothermic reaction is noted. The reaction mixture is heated to 95° C. for one hour. At this point the infra-red shows substantially no lactone absorption. Heating at 95° C. is continued for an additional two hours, followed by vacuum stripping to 95° C. at 25 millimeters mercury for three hours. The residue is filtered through diatomaceous earth filter aid. The dark orange liquid contains 5.02% sulfate ash which indicates 0.63% lithium content. The product has a total base number of 59.

EXAMPLE 5

A reactor is charged with 2500 parts of a propylene tetramer-substituted phenol prepared according to the procedure given in Example 2, 706 parts 50% aqueous glyoxylic acid (Aldrich) and 4.75 parts paratoluene sulfonic acid monohydrate (Eastman) and 650 parts toluene. The materials are heated under nitrogen at reflux (maximum temperature 140° C.) for 10 hours; 490 parts water is collected using a Dean-Stark trap. The reaction product is stripped to 130° C. at 20 millimeters mercury pressure over three hours. Mineral oil diluent (1261 parts) is added and the product is filtered through diatomaceous earth filter aid at 100° C. The infra-red spectrum shows an absorbance at 1795 $cm^{-1}$ indicating the presence of lactone. Another reactor is charged with 500 parts of this lactone-containing product, 48.4 parts 50% aqueous sodium hydroxide, 100 parts water and 83 parts mineral oil diluent. The materials are reacted under nitrogen at 95–100° C. for ten hours. The reaction mixture is vacuum stripped to 120° C. at 20 millimeters mercury pressure over three hours. The residue is filtered through a diatomaceous earth filter aid at 100–120° C. The filtered product shows 2.36% sodium, by analysis. The infra-red spectrum shows no lactone carbonyl absorption at 1795 $cm^{-1}$.

EXAMPLE 6

A reactor is charged with 2849 parts of a polypropylene substituted phenol prepared by alkylation of phenol with a polypropylene having a molecular weight of about 400 in the presence of a boron trifluoride-ether catalyst, 415 parts of 50% aqueous glyoxylic acid (Aldrich) and 4 parts of paratoluenesulfonic acid monohydrate (Eastman). The reactants are heated under nitrogen to 155–160° C. over three hours. Heating is continued at 155–160° C. for four hours. A total of 278 parts water is collected employing a Dean-Stark trap.

Another reactor is charged with 600 parts of the above-described product, 91 parts of 50% aqueous sodium hydroxide, about 347 parts toluene and 424 parts mineral oil. The materials are heated at reflux (maximum temperature –125° C.) for six hours. 54.5 parts water is collected using a Dean-Stark trap. The reaction mixture is stripped to 120° C. at 30 millimeters mercury pressure over three hours. The residue is filtered employing a diatomaceous earth filter aid at 110–120° C. The residue contains, by analysis, 2% sodium. The infra-red spectrum shows no lactone carbonyl absorption at 1795 $cm^{-1}$.

EXAMPLE 7

A reactor is charged with 700 parts of the polypropylene substituted phenol-glyoxylic acid reaction product described in Example 6, 24.5 parts calcium hydroxide, about 100 parts water and 483 parts mineral oil. The materials are heated under nitrogen to 95–100° C. and held at that temperature for eight hours. The infra-red spectrum at this point indicates lactone has been consumed. The materials are vacuum stripped to 100–105° C. at 20 millimeters mercury pressure over two hours. The residue is filtered at 100–105° C. employing a diatomaceous earth filter aid. The filtrate contains, by analysis, 0.934% calcium. The infra-red spectrum shows that a small amount of lactone remains.

EXAMPLE 8

A reactor is charged with 528 parts of a propylene-tetramer substituted phenol-glyoxylic acid reaction product prepared in the same manner described in Example 4, 18.5 parts sodium hydroxide, about 433 parts toluene and 40 parts water. The materials are heated under nitrogen at 85° C. (reflux) for four hours. Barium chloride dihydrate (Eastman) (56 parts) is added and the materials are heated at reflux for four hours followed by removal of water employing a Dean-Stark trap over three hours. The materials are cooled and solids are removed by filtration. The filtrate is stripped to 150° C. at 15 millimeters mercury pressure. The residue contains, by analysis, 2.82% barium and 1.01% sodium. The infra-red spectrum shows a weak lactone absorption.

EXAMPLE 9

A mixture is prepared by combining 680 parts of a polybutene-substituted phenol such as described in Example 1, 44.7 parts 50% aqueous glyoxylic acid (Aldrich) and 0.34 parts methanesulfonic acid in a reactor equipped with a subsurface gas inlet, thermowell, stirrer, and Dean-Stark trap with condenser. The materials are heated to 120° C. and held at that temperature for three hours; 24 parts water is collected. Mineral oil, 466 parts, is added followed by cooling of the materials to 73° C. A solution of 12.68 parts lithium hydroxide monohydrate is dissolved in 50 parts water. This solution is added to the reactor at 73° C. No exothermic reaction is noted. The Dean-Stark trap is removed and the condenser is replaced. The materials are heated to 95° C. and are held at that temperature for two hours. The materials are stripped at 95° C. at 20 millimeters mercury pressure for two hours. The residue is filtered through a diatomaceous earth filter aid at 95° C. The filtrate contains, by analysis, 0.51% lithium and 1.20% sulfate ash and has a total base number of 13.55. The ASTM color (D-1500 procedure) is 5.5.

EXAMPLE 10

A reactor is charged with 420 parts of a propylene-tetramer substituted phenol-glyoxylic acid reaction product prepared according to the procedure given in Example 4, 31 parts potassium hydroxide and about 260 parts toluene. The materials are heated under nitrogen to 120° C. and held at 120–130° C. for four hours. Following reaction, the infra-red spectrum shows no lactone remains. Naphthenic oil diluent (660 parts) is added followed by stripping to 140° C. at 2 millimeters mercury pressure for three hours. The residue is filtered through a diatomaceous earth filtrate at 130–140° C. The filtrate contains, by analysis, 1.47% potassium and has a total base number of 21.6.

For additional examples of preparation of hydrocarbyl-substituted carboxyalkylene-linked phenols of this type and their neutral salts, attention is directed to PCT publication WO 93/21143, particularly pages 32 to 38. The following are examples relating to preparation of overbased salts of this component of the invention:

EXAMPLE 11

(a). 3537 g of tetrapropylene-substituted phenol, 999 g glyoxylic acid, and 3.8 g methanesulfonic acid are charged to a 12 L 4-neck flask equipped with a stirred, thermowell, subsurface gas inlet, and Dean-Stark trap with condenser for water removal. The reaction mixture is heated to a final temperature of 160° C. over 3 hours under a nitrogen flow rate of 14 L/hr (0.5 $ft^3$/hr). The mixture is maintained at 160° C. for 4 hours, with removal of water. Diluent oil, 2910 g is added in one portion and the reaction mixture cooled to 25° C. to stand overnight.

(b) Thereafter 540 g of 50% aqueous sodium hydroxide and 1089 g water are added to the mixture in one portion. After an initial exotherm, the reaction is heated to 95–100° C. and maintained for 3 hours. After cooling the reaction mixture to +60° C., a vacuum of 13.3 kPa (100 mm Hg) is applied and vacuum stripping of water is begun. The temperature is slowly increased to 95–100° C. over 7 hours while the vacuum is reduced to 2.7 kPa (20 mm Hg). The mixture is maintained at this temperature and pressure for 3 hours. The reaction product is filtered through a filter aid at 90–100° C.

(c). The product prepared as in part (b), 2586 g, and 140 g diluent oil, are added to a 5 L flask equipped with stirrer, thermowell, subsurface inlet tube, and cold water condenser. The mixture is heated to 93° C. A solution of $CaCl_2$, 143 g, in 168 g water is added at 93° C. and mixed for 15 minutes. $Ca(OH)_2$, 185 g, is added and mixed for 15 minutes at 90–95° C. The mixture is heated under nitrogen flow, 28 L/hr (1 std. $ft^3$/hr), to 150° C. to remove volatiles. The mixture is cooled, and 260 g methanol is added. The mixture is heated to 50–52° C. and $CO_2$ addition is begun, at 28 L/hr (1 std. $ft^3$/hr). After about 2 hours the mixture is heated to 150° C. and maintained for 1 hour, to remove volatiles. The mixture is cooled, then reheated to 100° C. and isolated by centrifugation and filtration to remove solids.

EXAMPLE 12

Into a 3 L flask equipped with stirrer, thermowell, subsurface inlet tube, and cold water condenser are charged 1000 of product prepared as in Example 11(a) and 170 g diluent oil. The mixture is heated to 50° C. under a slight nitrogen flow. To the mixture is added 150 g of a mixture of isobutyl and amyl alcohols and a solution of 5.3 g $CaCl_2$ in 15 g water. Thereafter is added 48 g $Ca(OH)_2$. After a slight exotherm, the mixture is heated to reflux and maintained for 1.5 hours. The mixture is thereafter heated to 150° C. under a nitrogen flow of 28 L/hr (1 std. $ft^3$/hr) to remove volatiles, then cooled. The system is again heated to 50° C. and an additional 150 g of the isobutyl and amyl alcohols is added, along with 300 g methanol, followed by 134 g $Ca(OH)_2$. $CO_2$ is added to the mixture at 28 L/hr (1 std. $ft^3$/hr.) over a period of 2 hours. The mixture is again heated to 150° C. for 1 hour under nitrogen flow to strip volatiles. The mixture is cooled and filtered at 100° C. using a filter aid. The product is the filtrate.

EXAMPLE 13

Into a 3 L flask equipped as in Example 12 is charged 1500 g of material prepared as in Example 11(a), 32 g diluent oil, and 252 g of a mixture of isobutyl and amyl alcohols. The mixture is heated with stirring to 45° C. under a nitrogen flow of 14 L/hr (0.5 std. $ft^3$/hr.). To the mixture is charged 70 g $Ca(OH)_2$, 9.0 g acetic acid, and 18 g water at 38° C., while maintaining the nitrogen flow. After an exotherm, the mixture is heated to 95° C. and maintained at temperature for 1 hour. Thereafter the mixture is heated to 150° C. for 1 hour to strip volatiles. The product is cooled and filtered.

EXAMPLE 14

To a 3 L flask equipped as in Example 12 is charged 1293 g of material prepared as in Example 11(b) and heated to about 93° C. Diluent oil, 70 g, is added, followed by a solution of 71.5 g $CaCl_2$ in 84 g water, and the mixture stirred for 15 minutes. A charge of 67 g $Ca(OH)_2$ is added and mixed for 15 minutes at 90–95° C., followed by heating to 150° C. to dry and cooling to room temperature. The mixture is reheated to 50° C. and 130 g methanol is added. $CO_2$ is introduced into the mixture at 14 L/hr (0.5 std. $ft^3$/hr.) for about 75 minutes. The mixture is heated to 100° C. to strip for 30 minutes under a nitrogen flow of 28 L/hr (1.0 std. $ft^3$/hr). Thereafter the product is filtered using a filter aid.

EXAMPLE 15

Into a 5 L flask equipped as in Example 11(c) is charged 2376 g of material prepared as in Example 11(a) and 729 g diluent oil. The mixture is heated to 45° C. under a trace flow of nitrogen. To the mixture is added 140 g $Ca(OH)_2$, 434 g methanol, and 15.7 g acetic acid in 41 g water. After an exotherm, the mixture is stirred at 55° C. for 1 hour. Thereafter is added 131 g additional $Ca(OH)_2$ and the mixture carbonated at a $CO_2$ flow of 57 L/hr (2 std. $ft^3$/hr) to a neutralization number (to phenolphthalein) of 0. An additional charge of 131 g $Ca(OH)_2$ is added followed by carbonation at a $CO_2$ flow of 42 L/hr (1.5 std. $ft^3$/hr) to a neutralization number of 0, followed by additional ½ hour of $CO_2$ flow. The mixture is stripped of volatiles under 42 L/hr (1.5 std. $ft^3$/hr) nitrogen flow at 150° C. for 1 hour. The mixture is cooled to 90° C. and filtered using a filter aid.

EXAMPLE 16

Into a 2 L three-necked flask equipped with stirrer, thermowell, thermometer, subsurface tube, and condenser, is charged 814 g of material obtained as in Example 11(a), 52 g of a branched-chain aromatic sulfonic acid, molecular weight about 500, 300 g xylene, and 300 g diluent oil. The mixture is heated with stirring to 60° C. 60 g MgO is added and the mixture is further heated to 80° C. 150 g water is added and the mixture is heated to reflux (95–105° C.) for 1 hour. The mixture is heated to 150° C. under a nitrogen flow of 57 L/hr (2 std. $ft^3$/hr) to remove volatiles. The mixture is filtered warm through a filter aid.

EXAMPLE 17

Into a 5 L, 4 necked flask equipped as in Example 16 is charged 1424 g of material prepared as in Example 11(a), 91 g of a branched chain aromatic sulfonic acid, molecular weight about 500, and 500 g toluene. The mixture is heated with stirring to 60° C. 10g g MgO is added and the mixture heated to 80° C. Water, 300 g is added and the mixture heated to reflux (95–100° C.) for 2 hours. The mixture is heated to 150° C. under 42 L/hr (1.5 std $ft^3$/hr) nitrogen flow, followed by exposure at this temperature to vacuum, 2.9 kPa (22 mm Hg). The resulting mixture is filtered warm through a filter aid.

EXAMPLE 81

To a 3 L flask equipped as in the previous examples is charged 470 g of the 2:1 adduct of propylene tetramer-substituted phenol and glyoxylic acid, 17 g $Ca(OH)_2$, 400 mL xylene, and 20 g water. The mixture is heated under nitrogen at 90–92° C. for 2 hours. To the mixture is added 27.6 g MgO, and, as promoters, 20 g of a commercial alkyl sulfonic acid mixture and 40 mL methanol. The mixture is heated to 78–80° C. while blowing $CO_2$ for 6 hours at a rate of 6 L/hr (0.2 std. $ft^3$/hr). The mixture is heated to 150° C. under nitrogen flow for 2 hours to remove volatiles and thereafter vacuum stripped for 30 minutes at 150° C. and 3.3 kPa (25 mm Hg). The product is filtered through filter aid at 150° C.

EXAMPLE 82

To a 2 L flask equipped as in the previous examples is charged 592 g of the adduct of alkyl phenol and glyoxylic acid, overbased with $Ca(OH)_2$ (1 equivalent/equivalent adduct) and MgO (5 equivalents/equivalent adduct) and carbonated, prepared with commercial alkyl sulfonic acid promoter mixture by analogy with Example 81, except that in place of the propylene tetramer-substituted phenol material, a $C_{16}$-alkyl-substituted material is used. Further added to the flask is 30 g of polybutenyl maleic anhydride. The mixture is heated under nitrogen at 150–160° C. for 7 hours, then filtered at 130° C. through a filter aid, and twice again filtered through filter aid at 120–130° C.

EXAMPLE 83

(a). To a 5 L flask is added 1900 g of polybutenylphenol (molecular weight about 2020), 70 g glyoxylic acid, and 10 mL concentrated HCl. The mixture is heated under nitrogen at 160–190° C. for 10 hours, collecting 58 g water in a Dean-Stark trap. The product is collected for later use.

(b). To a 2 L flask is added 300 g of the material of part (a) of this example, 20 g $Ca(OH)_2$, 50 mL water, and 400 mL xylene. The mixture is heated under nitrogen to reflux (about 95° C.) for 12 hours. The reaction mixture is cooled and insoluble solids removed by filtration. The solvent is removed by stripping for 3 hours at 140° C. under 0.7 kPa (5 mm Hg).

Dihydrocarbyl Esters of Alkylene Dicarboxylic Acids

Alternatively, the acid material employed can be an overbased dihydrocarbyl ester of an alkylene dicarboxylic acid, the alkylene group being substituted with a hydroxy group and an additional carboxylic acid group. Such a material can have the structure

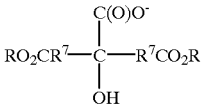

shown here in its presumed anionic form; the original acid would have a C(O)OH group. In this structure each $R^7$ is independently an alkylene group of 1 to 6 carbon atoms. Preferably $R^7$ is methylene. Each R can be independently an alkyl group containing at least 4 carbon atoms, preferably 4 to 50 carbon atoms, 4 to 30 carbon atoms, and more preferably 8 or 12 or 15 to 24 carbon atoms, provided that the total number of carbon atoms in all such R groups is at least 14, and preferably at least 16 or 24. Suitable R groups are described in greater detail above, in the description of the R groups for the hydrocarbyl-substituted carboxyalkylene-linked phenols. In this regard it is noted that the hydrocarbyl group represented by R can include groups of the general structure $R'(O—R'')_n—$, where the R' is typically an alkyl group, commonly of 8 to 30 carbon atoms, R" is an alkylene group of up to about 6 carbon atoms, such as ethylene or propylene, and n is 0 to 10, typically 1 to 4. Such R groups can be derived from so-called ethoxylated alcohols or propoxylated alcohols.

The preferred materials of this class are dialkylcitrates, represented by the structure

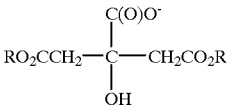

Dialkyl citrates are derived from citric acid, $HO_2CCH_2C(OH)(CO_2H)CH_2CO_2H$, which is a well-known commercially available material. The diesters are prepared by the esterification of citric acid with 2 moles of an appropriate alcohol under known esterification conditions. Among the other suitable alcohols which can be used are butyl alcohol, amyl alcohol, hexyl alcohol, octyl alcohol, decyl alcohol, and dodecyl alcohol, both in their linear and branched forms. Also included are alkoxylated alcohols, as described above.

The dihydrocarbyl ester of the alkylene dicarboxylic acid can be converted to its overbased form by standard overbasing conditions as described and exemplified above. However, it may be desired to employ somewhat milder conditions in terms of temperature, as the ester functionality can be subject to saponification.

EXAMPLE 18

Preparation of Didecyl Citrate

Into a 5 L flask equipped with stirrer, thermowell, subsurface gas inlet tube, and cold water condenser, and Dean-Stark trap, is charged 1152 g anhydrous citric acid and 1908 g decyl alcohol. The mixture is stirred and heated to 80° C. under a nitrogen flow of 7 L/hr (0.25 std. $ft^3$/hr). Toluene, 500 g, is added and the mixture heated to 130–140° C. while removing water azeotropically. After removal of about 212 mL water over a 15 hour period (over three days), the mixture is heated to 160° C. under a nitrogen flow of 28 L/hr (1.0 std. $ft^3$/hr) to remove the toluene. The mixture is held at this temperature for 2 hours, then cooled to room temperature. The mixture is reheated to 90° C. and filtered through a filter aid, to yield the ester as the filtrate.

EXAMPLE 19

Into a 3 L flask equipped with stirrer, thermowell, subsurface inlet tube, and cold water condenser, is charged 300 g of a mixture of isobutyl and amyl alcohols, a solution of 3.0 g $CaCl_2$ in 180 g methanol, and 195 g $Ca(OH)_2$. The mixture is stirred for 15 minutes and didecyl citrate, 900 g, is added slowly over a period of 30 minutes, maintaining a temperature below 50° C. After addition is complete, stirring is continued until exothermic activity ceases and the temperature begins to decrease. The mixture is heated to 50° C. under fast stirring, and $CO_2$ is added at 28 L/hr (1.0 std $ft^3$/hr) until the neutralization number (phenolphthalein) is about 0. The mixture is heated to 150° C. under a nitrogen flow of 28 L/hr (1.0 std. $ft^3$/hr) to remove volatiles, then cooled to room temperature. To the mixture is added 1000 g hexane and the mixture is stirred for 15 minutes at room temperature. The mixture is centrifuged for 1 hour, then decanted and stripped at 150° C. under a nitrogen flow of 28 L/hr (1.0 std. ft 3/hr). The material is cooled to 90° C. and filtered using a filter aid. The filtrate is the product.

EXAMPLE 20

Into a 2 liter, four-necked flask equipped with stirrer, thermowell, reflux condenser, and subsurface tube, is charged 660 g di($Cl_{12-18}$)alkyl citrate, 318 g diluent oil, and 248 g xylene. The mixture is heated with stirring to 50° C., whereupon is added 63 g MgO, 130 g methanol, and 101 g water. Carbon dioxide is blown through the mixture for 1 hour at 28 L/hr (1.0 std. $ft^3$/hr). After the 1 hour, the mixture is begun to be heated to 160° C. while still under $CO_2$, then vacuum stripped at 160° C. at 2.0 kPa (15 mm Hg). The product is filtered.

EXAMPLE 23

Into a 2 liter, four-necked flask equipped with stirrer, thermowell, reflux condenser, and subsurface tube, is charged 528 g didecyl citrate, 451 g diluent oil, and 248 g xylene. The mixture is heated to 50° C., whereupon is added 63 g MgO, 131 g methanol, 100 g water, and 1 g $MgCl_2$. Carbon dioxide is added to the mixture at 28L/hr (1 std. $ft^3$/hr) over 1 hour. A second increment of 63 g MgO and 10 g 30% aqueous ammonium hydroxide is added and $CO_2$ addition is continued for 3 hours. The mixture is heated to 160° C. and vacuum stripped at 2.0 kPa (15 mm Hg). The product is isolated by filtration.

EXAMPLE 24

Example 19 is substantially repeated, using in place of the didecyl citrate a mixed citric acid diester, comprising 80% isodecyl ester and 20% ester of a commercial $C_{8-10}$ alcohol (Alfol®810). The temperature during the addition of the ester is maintained below 40° C.

The Overbased Alkylene-linked Phenol/Carboxyphenol

Another suitable material is an overbased alkylene-linked polyaromatic molecule, the aromatic moieties whereof comprise at least one hydrocarbyl-substituted phenol and at least one carboxy phenol. In this embodiment the acidic material can be seen as the condensation product of an alkyl phenol, a salicylic acid or its equivalent, and an aldehyde. More generally, this material comprises at least one alkylene-linked polyaromatic molecule, the aromatic moieties whereof comprise at least one hydrocarbyl-substituted phenol and at least one carboxy phenol, which acidic material is present as an anion represented by (VII)

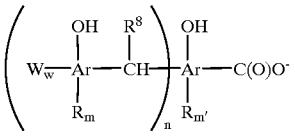

In this structure $R^8$ is hydrogen or an alkyl group of 1 to about 6 carbon atoms, corresponding to the aldehyde from which it is derived (hydrogen, for formaldehyde, methyl for acetaldehyde, and so on. In this structure, each Ar is an aromatic group, as defined above, and R is likewise as has been defined above; typically in this context each R is independently an alkyl group containing 4 to 50 carbon atoms, preferably 7 to 30 carbon atoms, and more preferably 8 or 12 or even 15 to 24 carbon atoms. However, the total number of carbon atoms in the R groups of the molecule should be at least 7, preferably at least 14 or 16. Alternatively, in one embodiment R is an olefin polymer substituent. In the above structure n is 1 or 2 and m is 1, 2, or 3, and m' is 0, 1, or 2. In the above structure W represents (VIII)

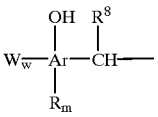

and each w (in the first and any subsequent W groups) is independently 0 or 1. That is to say, the structure can comprise more than two aromatic units linked by alkylene bridges. Generally the number of aromatic units thus linked will not exceed 4 or, preferably 3. In a preferred embodiment, w is 0.

In particular, when this component is the preferred condensate of an alkyl phenol, a salicylate, and formaldehyde, it will have a structure represented, in its ionic form by

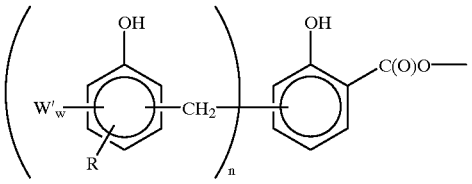

where W' is $W'_w(R)(OH)\phi—CH_2$- and $\phi$ is a benzene ring.

This class of materials is prepared by reacting an alkylphenol with a salicylic acid and an aldehyde such as formaldehyde (or a reactive equivalent such as paraformaldehyde) under condensing conditions, followed by overbasing of the product. In general, this reaction can be conducted by mixing the phenol, the salicylic acid, and the aldehyde in an inert solvent, along with a small amount of base such as sodium hydroxide. The mixture is typically heated to a suitable temperature to effect the reaction, followed by removal of water to drive the condensation to completion. The mole ratios of the phenol and the salicylic acid is not particularly critical; typically 1:5 to 9:1 can be employed, more commonly 1:1 to 3: 1, preferably about 2:1. The amount of aldehyde is typically approximately 1 equivalent per mole of phenol, although slight excess (e.g., 30%, 20%, or 10%) is commonly employed to assure complete reaction of the phenol and the salicylic acid. The use of excess aldehyde can lead to further condensation reactions and higher molecular weight product, which can be desired under certain circumstances and are encompassed within the scope of the present invention. The reaction temperature for the condensation can be, for instance 80 to 150° C., preferably 100 to 130° C. Isolation of the adduct is by conventional means. Thereafter the adduct is overbased by techniques as described above.

EXAMPLE 25

(a) To a 3 L, 4-neck flask, equipped with stirrer, thermometer, and condenser, is charged 532 g of $C_{12}$ alkyl substituted phenol and 700 g xylene. With stirring is added 4 g 50% aqueous sodium hydroxide and 1 g water. The mixture is heated to 85° C. and paraformaldehyde $(CH_2O)_x$, 66 g, is added over 10 minutes. The mixture is heated to 100° C. and maintained at temperature for 4 hours, then allowed to cool. To the mixture is charged, with stirring, 140 g salicylic acid. The mixture is heated to reflux at about 120° C. and azeotropically dried over a course of about 6 hours, reaching a maximum temperature of 147° C., which is maintained for 1 hour. The product, to which is added 300 g diluent oil, is isolated by filtration through paper and filter aid to yield about 1660 g intermediate mixture.

(b) To a 3 L flask fitted with a stirrer, thermometer, subsurface sparger, and a condenser is charged 103 g $Ca(OH)_2$ and 113 g of a mixture of isobutyl and amyl alcohols. The mixture is stirred and 2.98 g $CaCl_2$ in 7.9 g water is added. To the mixture, at room temperature, is added 1579 g of mixture prepared as in part (a) of this example. The addition takes place over a period of about 21 minutes, during which the mixture undergoes an exothermic reaction. The mixture is heated to 99° C. and held for 1 hour at 99–100° C. The mixture is heated to 150° C. and held for 15 minutes to remove volatile materials. The mixture is allowed to cool, and thereafter charged with 113 g methanol and heated to 50° C. Addition of carbon dioxide is begun at 14 L/hr (0.5 std. $ft^3$/hr) and the temperature maintained at 50–51° C. for about 1½ hours. The mixture is heated to about 156° C. under nitrogen (14 L/hr, 0.4 std $ft^3$/hr) to remove volatiles, then further heated to 157° C. for ½ hour at 2.9 kPa (22 mm Hg). The resulting product, after cooling, is isolated by filtration.

Lubricants of the present invention will normally comprise an amount of the overbased materials hereinabove described, sufficient to provide improved detergency, antioxidant properties, or asphaltene suspension (compared to the same composition, absent the overbased material), plus other optional components, in a medium of an oil of lubricating viscosity. Characteristic amount of these overbased materials are typically 0.1 to 15% by weight (on an oil-free basis) in a finally formulated lubricant, preferably 0.5 to 8% (in e.g. a marine diesel application or 0.2 to 4% (in e.g. a passenger car motor oil application), and even more preferably 1 to 2% by weight. In a concentrate, the amount of these materials will be correspondingly increased.

As previously indicated, the metal salts of this invention are useful as additives in preparing lubricant compositions where they function to improve, for example, detergency, dispersancy, particularly of asphaltene components, anti-rust, antioxidancy and the like.

The lubricating oil compositions of this invention are based on natural and synthetic lubricating oils and mixtures thereof. These lubricants include crankcase lubricating oils for spark-ignited and compression-ignited internal combustion engines, such as automobile and truck engines, marine and railroad diesel engines, and the like. Automatic transmission fluids, transaxle lubricants, gear lubricants, metal-working lubricants, hydraulic fluids and other lubricating oil and grease compositions can also benefit from the incorporation therein of the metal salts of this invention.

In addition to the overbased metal salts described above, the use of other additives is contemplated.

It is sometimes useful to incorporate, on an optional, as-needed basis, other known additives which include, but are not limited to, dispersants and detergents of the ash-producing or ashless type, antioxidants, anti-wear agents, extreme pressure agents, emulsifiers, demulsifiers, foam inhibitors, friction modifiers, anti-rust agents, corrosion inhibitors, viscosity improvers, pour point depressants, dyes, lubricity agents, and solvents to improve handleability which may include alkyl and/or aryl hydrocarbons. These optional additives may be present in various amounts depending on the intended application for the final product or may be excluded therefrom.

The ash-containing detergents are the well-known neutral or basic Newtonian or non-Newtonian, basic salts of alkali, alkaline earth and transition metals with one or more hydrocarbyl sulfonic acid, carboxylic acid, phosphoric acid, mono- and/or dithio phosphoric acid, phenol or sulfur coupled phenol, and phosphinic and thiophosphinic acid. Commonly used metals are sodium, potassium, calcium, magnesium, lithium, and the like. Sodium, magnesium, and calcium are most commonly used.

Neutral salts contain substantially equivalent amounts of metal and acid. As used herein, the expression basic salts refers to those compositions containing an excess amount of metal over that normally required to neutralize the acid substrate. Such basic compounds are frequently referred to as overbased, superbased, etc.

Dispersants include, but are not limited to, hydrocarbon substituted succinimides, succinamides, carboxylic esters, Mannich dispersants and mixtures thereof as well as materials functioning both as dispersants and viscosity improvers. The dispersants include nitrogen-containing carboxylic dispersants, ester dispersants, Mannich dispersants or mixtures thereof. Nitrogen-containing carboxylic dispersants are prepared by reacting a hydrocarbyl carboxylic acylating agent (usually a hydrocarbyl substituted succinic anhydride) with an amine (usually a polyamine). Ester dispersants are prepared by reacting a polyhydroxy compound with a hydrocarbyl carboxylic acylating agent. The ester dispersant may be further treated with an amine. Mannich dispersants are prepared by reacting a hydroxy aromatic compound with an amine and aldehyde. The dispersants listed above may be post-treated with reagents such as urea, thiourea, carbon disulfide, aldehydes, ketones, carboxylic acids, hydrocarbon substituted succinic anhydride, nitriles, epoxides, boron compounds, phosphorus compounds and the like. These dispersants are generally referred to as ashless dispersants even though they may contain elements such as boron or phosphorus which, on decomposition, will leave a non-metallic residue.

Extreme pressure agents and corrosion- and oxidation-inhibiting agents include chlorinated compounds, sulfurized compounds, phosphorus containing compounds including, but not limited to, phosphosulfurized hydrocarbons and phosphorus esters, metal containing compounds and boron containing compounds.

Chlorinated compounds are exemplified by chlorinated aliphatic hydrocarbons such as chlorinated wax.

Examples of sulfurized compounds are organic sulfides and polysulfides such as benzyl disulfide, bis(chlorobenzyl) disulfide, dibutyl tetrasulfide, sulfurized methyl ester of oleic acid, sulfurized alkylphenol, sulfurized dipentene, and sulfurized terpene.

Phosphosulfurized hydrocarbons include the reaction product of a phosphorus sulfide with turpentine or methyl oleate.

Phosphorus esters include dihydrocarbon and trihydrocarbon phosphites, phosphates and metal and amine salts thereof.

Phosphites may be represented by the following formulae:

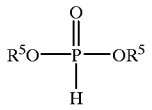

wherein each R5 is independently hydrogen or a hydrocarbon based group, provided at least one $R^5$ is a hydrocarbon based group.

Phosphate esters include mono-, di- and trihydrocarbon-based phosphates of the general formula $$(R^5O)_3PO.$$

Examples include mono-, di- and trialkyl; mono-, di and triaryl and mixed alkyl and aryl phosphates.

Metal containing compounds include metal thiocarbamates, such as zinc dioctyldithiocarbamate, and barium heptylphenyl dithiocarbamate, molybdenum compounds, organodithiophosphate salts such as zinc, copper, manganese, etc., salts.

Boron containing compounds include borate esters and boron-nitrogen containing compounds prepared, for example, by the reaction of boric acid with a primary or secondary alkyl amine.

Viscosity improvers include, but arc not limited to, polyisobutenes, polymethacrylate acid esters, polyacrylate acid esters, diene polymers, polyalkyl styrenes, alkenyl aryl conjugated diene copolymers, polyolefins and multifunctional viscosity improvers.

Pour point depressants are a particularly useful type of additive often included in the lubricating oils described herein. See for example, page 8 of "Lubricant Additives" by C. V. Smalheer and R. Kennedy Smith (Lesius-Hiles Company Publishers, Cleveland, Ohio, 1967).

Diluents include such materials as high boiling petroleum naphthas, mineral oil, etc. When used, they are typically present in amounts ranging from about 5% to about 25% by weight.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125–162.

These and other additives are described in greater detail in U.S. Pat. No. 4,582,618 (column 14, line 52 through column 17, line 16, inclusive), herein incorporated by reference for its disclosure of other additives that may be used in the compositions of the present invention.

The components may be blended together in any suitable manner and then admixed, for example with a diluent to form a concentrate as discussed below, or with a lubricating oil, as discussed below. Alternatively, components can be admixed separately with such diluent or lubricating oil. The blending technique for mixing the components is not critical and can be effected using any standard technique, depending upon the specific nature of the materials employed. In general, blending can be accomplished at room temperature; however, blending can be facilitated by heating the components.

As previously indicated, the compositions of the present invention are useful as additives for lubricants. They can be employed in a variety of lubricant basestocks comprising diverse oils of lubricating viscosity, including natural and synthetic lubricating oils and mixtures thereof.

Natural oils include animal oils, vegetable oils, mineral lubricating oils, solvent or acid treated mineral oils, and oils derived from coal or shale. Synthetic lubricating oils include hydrocarbon oils, halo-substituted hydrocarbon oils, alkylene oxide polymers, esters of carboxylic acids and polyols, esters of polycarboxylic acids and alcohols, esters of phosphorus-containing acids, polymeric tetrahydrofurans, silicon-based oils and mixtures thereof.

Specific examples of oils of lubricating viscosity are described in U.S. Pat. No. 4,326,972. A basic, brief description of lubricant base oils appears in an article by D. V. Brock, "Lubricant Base Oils",*Lubrication Engineering*, volume 43, pages 184–185, March, 1987.

The additives and components of this invention can be added directly to the lubricant. Preferably, however, they are diluted with a substantially inert, normally liquid organic diluent such as mineral oil, naphtha, toluene or xylene, to form an additive concentrate. These concentrates usually contain from about 10% to about 90% by weight of the components used in the composition of this invention and may contain, in addition, one or more other additives known in the art as described hereinabove. The remainder of the concentrate is the substantially inert normally liquid diluent.

EXAMPLES 30–46

Lubricants are prepared in a solvent-refined 600 Neutral base oil containing 4.5% (including diluent oil) of a 250 TBN calcium overbased sulfur-coupled alkyl phenol, 0.6% of a commercial zinc dithiophosphate extreme pressure agent, and 20 ppm silicone antifoam agent. Specific formulations are shown in Table I and contain the material from the indicated examples above, in amounts which include the diluent oils contained therein:

TABLE I

| Ex. | Product of Ex. | % |
|---|---|---|
| 30 | 1 | 5.0 |
| 31 | 11(a) | 2.0 |
| 31.5 | 11(b) | 3.0 |
| 32 | 11(c) | 2.0 |
| 33 | 12 | 3.0 |
| 34 | 13 | 1.5 |
| 35 | 14 | 0.2 |
| 36 | 15 | 30 |
| 37 | 16 | 1.0 |
| 38 | 17 | 15 |
| 39 | 19 | 3.0 |

TABLE I-continued

| Ex. | Product of Ex. | % |
|---|---|---|
| 40 | 20 | 4.0 |
| 43 | 23 | 3.0 |
| 44 | 24 | 3.0 |
| 45 | 25(a) | 3.0 |
| 46 | 25(b) | 3.0 |

EXAMPLE 50–65

Lubricant compositions are prepared in a solvent-refined 600 Neutral base oil containing, in turn, the products of Examples 11(a)(at 3% by weight, including the diluent oil), 11(c) (at 5% by weight, including diluent), 13 (at 3% by weight, including diluent), and 15 (at 5% by weight, including the diluent), each with the following additives:

| Ex. | Additive type, % |
|---|---|
| 50–53 | commercially avail. trunk piston engine oil package (package A), 8.0 |
| 54–57 | package A, 8.0, + TBN booster (package B), 5.6 |
| 58–61 | trunk piston engine oil package (package C), 12.5 |
| 62–65 | NONE |

Package A contributes (a) 5 to 6% of a mixture of low TBN and high TBN calcium overbased alkyl benzene sulfonate and sulfur coupled alkyl phenol detergents, (b) 1 to 2% of a 10 TBN polyalkenyl succinimide dispersant, (c) 0.5 to 1% of a zinc dithiophosphate extreme pressure agent, and (d) less than 1% total of each antirust agents, commercial phenolic resin demulsifier, and commercial silicone anti-foam agent, for a total additive of 8%. Each of the listed components contains the diluent oils normally found in the commercial materials, normally in amounts of 0 up to about 50% of the particular component.

Package B contributes (a) 4 to 5% of a mixture of high TBN calcium overbased sulfur-coupled alkyl phenol and alkyl benzene sulfonate detergent, (b) 0.5 to 1.5% of a 70 TBN polyalkenyl succinimide dispersant, and less than 100 ppm silicone anti-foam agent, for a total contribution of 5.6%. As in package A, the listed components may contain diluent oil.

Package C contributes (a) 9 to 11% of a mixture of low and high TBN calcium petroleum sulfonate, calcium overbased alkylbenzene sulfonate, and calcium overbased sulfur-coupled alkyl phenol detergents, (b) 1 to 2% of a 10 TBN polyalkenyl succinimide dispersant, 0.5 to 1% of a zinc dithiophosphate extreme pressure agent, and less than 1% total of each of antirust agents, commercial phenolic resin demulsifier, and silicone anti-foam agent, for a total additive of 12.5%. As in package A, the listed components may contain diluent oil.

In packages A, B, and C, "high TBN" refers to a total base number of 200–400, and "low TBN" refers to a total base number of less than 100.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated (as in the preparative examples). As used herein, the expression "consisting essentially of" permits the inclusion of substances which do not materially affect the basic and novel characteristics of the composition under consideration.

What is claimed is:

1. An overbased metal salt of a hydrocarbyl-substituted carboxyalkylene-linked phenol, the hydrocarbyl group or groups thereof being of sufficient length to provide oil solubility to the salt;

wherein the overbased metal salt has a metal ratio of at least 1.3.

2. The overbased metal salt of claim 1 wherein the acidic material is a hydrocarbyl-substituted carboxyalkylene-linked phenol which is present as an anion represented by (II)

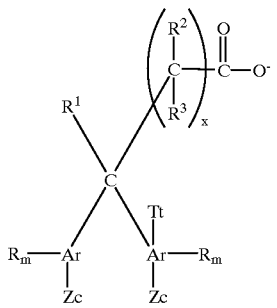

wherein T is selected from the group consisting of (V)

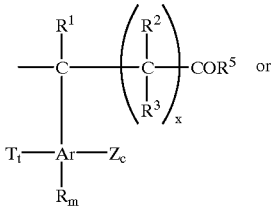

(VI)

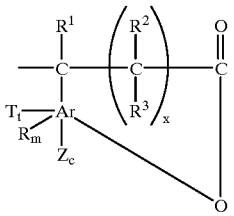

wherein each $R^5$ is independently selected from $O^-$ and $OR^6$ wherein $R^6$ is H or alkyl and each t is independently 0 or 1, provided that when t in formula II is 1, then up to about 3 additional groups T are present, terminating when t in formula V or VI is zero; wherein T is as hereinbefore defined and wherein each Ar is independently an aromatic group of from 4 to about 30 carbon atoms having from 0 to 3 optional substituents selected from the group consisting of polyalkoxyalkyl, lower alkoxy, nitro, halo, or combinations of two or more of said optional substituents, each R is independently alkyl, alkenyl, or aryl containing at least 4 carbon atoms, provided that the total number of carbon atoms in all such R groups is at least about 12, $R^1$ is H or a hydrocarbyl group, $R^2$ and $R^3$ are each independently H or a hydrocarbyl group, each m is independently an integer ranging from 1 to about 10, x ranges from 0 to about 8, and each Z is independently OH, $(OR^4)_bOH$, or $O^-$ wherein each $R^4$ is independently a divalent hydrocarbyl group and b is a number ranging from 1 to about 30 and c ranges from 0 to about 3 with the proviso that when t in formula (II)=0, or when T is formula (V), then c is not 0, provided that the sum of m, c, and t does not exceed the valences of the corresponding Ar.

3. The overbased metal salt of claim 2 wherein each Ar is independently a single ring aromatic group, a fused ring aromatic group, or a linked aromatic group.

4. The overbased metal salt of claim 2 wherein the anion is represented by the structure

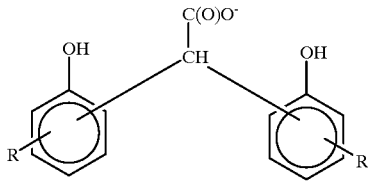

wherein each R is independently alkyl, alkenyl, or aryl containing at least 4 carbon atoms.

5. The overbased metal salt of claim 4 wherein each R is independently an alkyl group containing about 4 to about 50 carbon atoms.

6. The overbased metal salt of claim 5 wherein each R independently contains about 4 to about 30 carbon atoms.

7. The overbased metal salt of claim 5 wherein each R independently contains about 7 to 24 carbon atoms.

8. The overbased metal salt of claim 4 wherein each R is an olefin polymer substituent.

9. The overbased metal salt of claim 1 wherein the metal is selected from group IA, IIA, or IIB of the periodic table.

10. The overbased metal salt of claim 9 wherein the metal is calcium, magnesium, or sodium.

11. The overbased metal salt of claim 9 wherein the metal is calcium.

12. The overbased metal salt of claim 1 wherein the metal ratio is at least about 1.5.

13. A composition comprising the overbased salt of claim 1 and a concentrate-forming amount of an oil of lubricating viscosity.

14. A lubricant comprising:

(a) an oil of lubricating viscosity, and (b) an overbased metal salt of a hydrocarbyl-substituted carboxyalkylene-linked phenol, the hydrocarbyl group or groups thereof being of sufficient length to provide oil solubility to the salt;

wherein the overbased metal salt has a metal ratio of at least 1.3.

15. The lubricant of claim 14 wherein the acidic material is a hydrocarbyl-substituted carboxyalkylene-linked phenol which is present as an anion represented by (II)

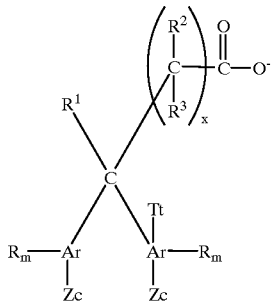

wherein T is selected from the group consisting of (V)

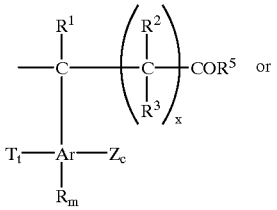

(VI)

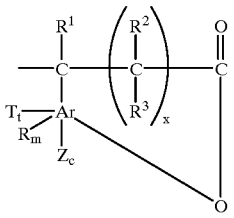

wherein each $R^5$is independently selected from $O^-$and $OR^6$ wherein $R^6$ is H or alkyl and each t is independently 0 or 1, provided that when t in formula II is 1, then up to about 3 additional groups T are present, terminating when t in formula V or VI is zero; wherein T is as hereinbefore defined and wherein each Ar is independently an aromatic group of from 4 to about 30 carbon atoms having from 0 to 3 optional substituents selected from the group consisting of polyalkoxyalkyl, lower alkoxy, nitro, halo, or combinations of two or more of said optional substituents, each R is independently alkyl, alkenyl, or aryl containing at least 4 carbon atoms, provided that the total number of carbon atoms in all such R groups is at least about 12, $R^1$ is H or a hydrocarbyl group, $R^2$ and $R^3$ are each independently H or a hydrocarbyl group, each m is independently an integer ranging from 1 to about 10, x ranges from 0 to about 8, and each Z is independently OH, $(OR^4)_bOH$, or $O^-$ wherein each $R^4$ is independently a divalent hydrocarbyl group and b is a number ranging from 1 to about 30 and c ranges from 0 to about 3 with the proviso that when t in formula (II)=0, or when T is formula (V), then c is not 0, provided that the sum of m, c, and t does not exceed the valences of the corresponding Ar.

16. The lubricant of claim 14 wherein the anion is represented by the structure

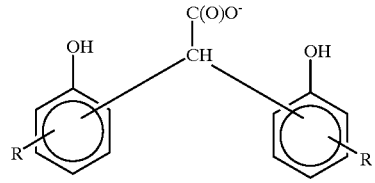

wherein each R is independently alkyl, alkenyl, or aryl containing at least 4 carbon atoms.

17. The lubricant of claim 16 wherein each R is independently an alkyl group containing about 4 to about 50 carbon atoms.

18. The lubricant of claim 16 wherein each R independently contains about 7 to 24 carbon atoms.

19. The lubricant of claim 16 wherein each R is an olefin polymer substituent.

20. The lubricant of claim 14 wherein the metal is selected from group IA, IIA, or IIB of the periodic table.

21. The lubricant of claim 20 wherein the metal is calcium, magnesium, or sodium.

22. The lubricant of claim 20 wherein the metal is calcium.

23. The lubricant claim 14 wherein the metal ratio is at least about 1.3.

24. The lubricant of claim 14 wherein the overbased metal salt comprises about 0.1 to about 15% by weight of the composition.

25. The lubricant of claim 14 wherein the overbased salt comprises about 0.5 to about 8% by weight of the composition.

26. The lubricant of claim 14 wherein the overbased salt comprises about 0.2 to about 4% by weight of the composition.

27. The lubricant of claim 14 wherein the overbased salt comprises about 1 to about 2% by weight of the composition.

28. A method for lubricating an internal combustion engine, comprising supplying to the engine the lubricant of claim 14.

29. The method of claim 28 wherein the engine is an engine which burns fuel containing asphaltene components.

30. The method of claim 29 wherein the acidic material is a hydrocarbyl-substituted carboxyalkylene-linked phenol which is present as an anion represented by (II)

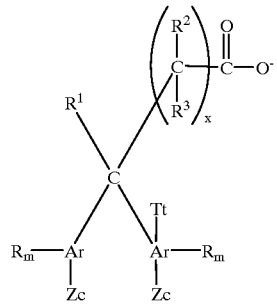

wherein T is selected from the group consisting of (V)

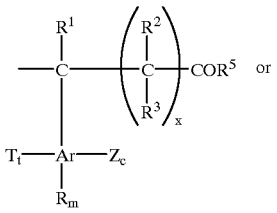

or (VI)

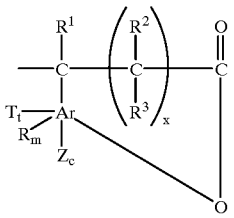

wherein each $R^5$ is independently selected from $O^-$ and $OR^6$ wherein $R^6$ is H or alkyl and each t is independently 0 or 1, provided that when t in formula II is 1, then up to about 3 additional groups T are present, terminating when t in formula V or VI is zero; wherein T is as hereinbefore defined and wherein each Ar is independently an aromatic group of from 4 to about 30 carbon atoms having from 0 to 3 optional substituents selected from the group consisting of polyalkoxyalkyl, lower alkoxy, nitro, halo, or combinations of two or more of said optional substituents, each R is independently alkyl, alkenyl, or aryl containing at least 4 carbon atoms provided that the total number of carbon atoms in all such R groups is at least about 12, $R^1$ is H or a hydrocarbyl group, $R^2$ and $R^3$ are each independently H or a hydrocarbyl group, each m is independently an integer ranging from 1 to about 10, x ranges from 0 to about 8, and each Z is independently OH, $(OR^4)_bOH$, or $O^-$ wherein each $R^4$ is independently a divalent hydrocarbyl group and b is a number ranging from 1 to about 30 and c ranges from 0 to about 3 with the proviso that when t in formula (II)=0, or when T is formula (V), then c is not 0, provided that the sum of m, c, and t does not exceed the valences of the corresponding Ar.

31. The method of claim 30 wherein the anion is represented by the structure

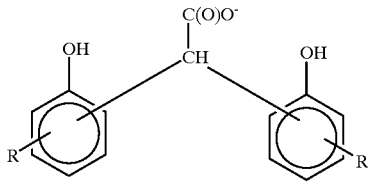

wherein each R is independently alkyl, alkenyl, or aryl containing at least 4 carbon atoms.

32. The method of claim 31 wherein each R is independently an alkyl group containing about 4 to about 50 carbon atoms.

33. The method of claim 31 wherein each R independently contains about 7 to 24 carbon atoms.

34. The method of claim 31 wherein each R is an olefin polymer substituent.

35. The method of claim 29 wherein the metal is selected from group IA, IIA, or IIB of the periodic table.

36. The method of claim 35 wherein the metal is calcium.

37. The method of claim 29 wherein the metal ratio is at least about 1.3.

38. The method of claim 29 wherein the overbased metal salt comprises about 0.1 to about 15% by weight of the composition.

39. The method of claim 29 wherein the overbased salt comprises about 0.5 to about 8% by weight of the composition.

40. The method of claim 29 wherein the internal combustion engine is a marine diesel engine.

41. The lubricant of claim 14 wherein the lubricant is a grease.

42. The lubricant of claim 41 wherein the metal is zinc.

* * * * *